US009847050B2

(12) United States Patent
Yata et al.

(10) Patent No.: US 9,847,050 B2
(45) Date of Patent: Dec. 19, 2017

(54) DISPLAY DEVICE AND COLOR CONVERSION METHOD

(71) Applicant: Japan Display .Inc., Tokyo (JP)

(72) Inventors: Tatsuya Yata, Tokyo (JP); Takayuki Nakanishi, Tokyo (JP)

(73) Assignee: Japan Display Inc., Tokyo (JP)

( * ) Notice: Subject to any disclaimer, the term of this patent is extended or adjusted under 35 U.S.C. 154(b) by 298 days.

(21) Appl. No.: 14/519,751

(22) Filed: Oct. 21, 2014

(65) Prior Publication Data

US 2015/0109319 A1 Apr. 23, 2015

(30) Foreign Application Priority Data

Oct. 22, 2013 (JP) ..... 2013-219700
Oct. 17, 2014 (JP) ..... 2014-213106

(51) Int. Cl.
*G09G 3/20* (2006.01)

(52) U.S. Cl.
CPC ... *G09G 3/2003* (2013.01); *G09G 2300/0452* (2013.01); *G09G 2320/0613* (2013.01); *G09G 2330/021* (2013.01); *G09G 2340/06* (2013.01); *G09G 2360/16* (2013.01)

(58) Field of Classification Search
CPC ..... G09G 3/2003; G09G 3/3225; G09G 2300/0452; G09G 2360/16; G09G 2330/021; G09G 2340/06; G09G 2320/0613
See application file for complete search history.

(56) References Cited

U.S. PATENT DOCUMENTS 6,885,380 B1 4/2005 Primerano et al.
2004/0113875 A1* 6/2004 Miller ..... G09G 3/3216 345/82
2004/0178743 A1* 9/2004 Miller ..... G09G 3/3225 315/169.3
2007/0115392 A1* 5/2007 Masuda ..... H04N 5/20 348/678
2014/0225933 A1* 8/2014 Park ..... G09G 5/10 345/690

FOREIGN PATENT DOCUMENTS

JP 2007-514184 5/2007
WO 2005/048232 5/2005

* cited by examiner

*Primary Examiner* — Xiao Wu
*Assistant Examiner* — Chong Wu
(74) *Attorney, Agent, or Firm* — K&L Gates LLP

(57) ABSTRACT

The display device includes an image display unit including pixels each including first to third sub-pixels and a fourth sub-pixel for displaying an additional color component according to an amount of lighting of a self-emitting element; a conversion processing unit that performs, for all of pixels, an image analysis on first color information for display at a predetermined pixel, and if a predicted value of power consumption as a total amount of lighting of self-emitting elements is above a limit, outputs a second input signal through a color conversion process on a first input signal including the first color information at a color conversion rate associated with the predicted value; and a fourth sub-pixel signal processing unit that outputs, to the image display unit, a third input signal including third color information with converted red, green, blue, and additional color components.

6 Claims, 19 Drawing Sheets

DISPLAY DEVICE AND COLOR CONVERSION METHOD

CROSS REFERENCES TO RELATED APPLICATIONS

The present application claims priority to Japanese Priority Patent Application JP 2013-219700 filed in the Japan Patent Office on Oct. 22, 2013, and JP 2014-213106 filed in the Japan Patent Office on Oct. 17, 2014, the entire content of which is hereby incorporated by reference.

BACKGROUND

1. Field of the Invention

The present disclosure relates to a display device, an electronic apparatus, and a color conversion method.

2. Description of the Related Art

Conventionally, a liquid crystal display device with an RGBW-type liquid crystal panel that is provided with pixels W (white) in addition to pixels R (red), G (green), and B (blue) has been employed. The RGBW-type liquid crystal display device displays images while allocating, to the pixels W, transmission amounts of light from a backlight through the pixels R, G, and B based on RGB data that determines display of images, thereby making it possible to reduce luminance of the backlight and thus reduce power consumption.

In addition to the liquid crystal display device, an image display panel that lights self-emitting elements, such as organic light-emitting diodes (OLEDs), has been known. For example, Japanese Translation of PCT International Application Publication No. 2007-514184 (JP-T-2007-514184) describes a method of converting a three-color input signal (R, G, B) corresponding to three color-gamut defining primary colors to a four-color output signal (R', G', B', W) corresponding to the color-gamut defining primary colors and one additional primary color W in order to drive a display device including light-emitting elements that emit light corresponding to the four-color output signal.

In the display device including the image display panel that lights the self-emitting elements, a backlight is not needed and the amount of power of the display device is determined according to the amounts of lighting of the self-emitting elements of respective pixels. When a conversion process is simply performed by the method described in JP-A-2007-514184, it is possible to increase the value (also called as brightness) of a screen with use of the four-color output signal (R', G', B', W) including the additional pixel W (white), as compared to representation with the three-color input signal (R, G, B) corresponding to the three color-gamut defining primary colors. However, the amount of lighting of the self-emitting elements increases and power consumption may not be reduced.

For the foregoing reasons, there is a need for a display device and a color conversion method capable of suppressing power consumption in an image display unit that lights self-emitting elements.

SUMMARY

According to an aspect, a display device includes: an image display unit including a plurality of pixels, each of the pixels including a first sub-pixel for displaying a red component according to an amount of lighting of a self-emitting element; a second sub-pixel for displaying a green component according to an amount of lighting of a self-emitting element; a third sub-pixel for displaying a blue component according to an amount of lighting of a self-emitting element; and a fourth sub-pixel for displaying an additional color component different from the respective components of the first sub-pixel, the second sub-pixel, and the third sub-pixel according to an amount of lighting of a self-emitting element, and having a higher luminance or a higher power efficiency to display the additional color component as compared to representation with the first sub-pixel, the second sub-pixel, and the third sub-pixel; a conversion processing unit configured to perform, for all of pixels, an image analysis on first color information used for display at a predetermined pixel, and, if a predicted value of power consumption that is obtained as a total amount of lighting of the self-emitting elements according to the image analysis is above a power limit value, output a second input signal that is obtained by performing a color conversion process on a first input signal including the first color information at a color conversion rate associated with the predicted value of power consumption; and a fourth sub-pixel signal processing unit configured to output, to a drive circuit that drives the image display unit, a third input signal including third color information with the red component, the green component, the blue component, and the additional color component that are converted based on the second color information in the second input signal.

According to another aspect, a color conversion method on an input signal supplied to a drive circuit of an image display unit is provided. The image display unit includes a plurality of pixels, each of the pixels including: a first sub-pixel for displaying a red component according to an amount of lighting of a self-emitting element; a second sub-pixel for displaying a green component according to an amount of lighting of a self-emitting element; a third sub-pixel for displaying a blue component according to an amount of lighting of a self-emitting element; and a fourth sub-pixel for displaying an additional color component different from the respective components of the first sub-pixel, the second sub-pixel, and the third sub-pixel according to an amount of lighting of a self-emitting element, and having a higher luminance or a higher power efficiency to display the additional color component as compared to representation with the first sub-pixel, the second sub-pixel, and the third sub-pixel. The color conversion method includes: performing, for all of pixels, an image analysis on first color information used for display at a predetermined pixel; outputting, if a predicted value of power consumption that is obtained as a total amount of lighting of the self-emitting elements according to the image analysis is above a power limit value, a second input signal that is obtained by performing a color conversion process on a first input signal including the first color information at a color conversion rate associated with the predicted value of power consumption; and outputting, to the image display unit, a third input signal including third color information with the red component, the green component, the blue component, and the additional color component that are converted based on the second color information in the second input signal.

Additional features and advantages are described herein, and will be apparent from the following Detailed Description and the figures.

DETAILED DESCRIPTION

Figure 1:
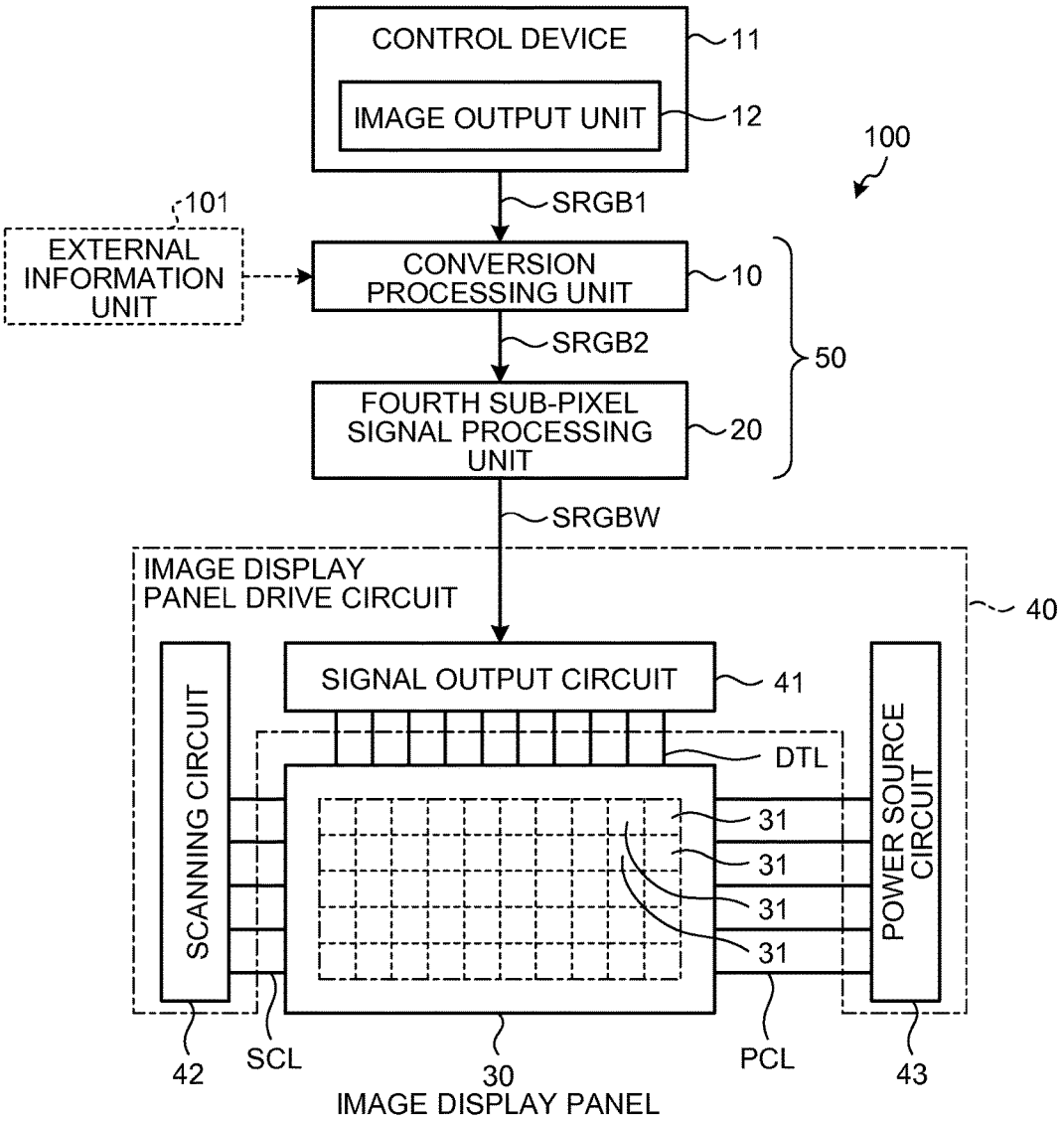
FIG. 1 is a block diagram illustrating an example of a configuration of a display device according to an embodiment.

Exemplary embodiments for carrying out the present disclosure will be described in detail below with reference to the accompanying drawings. The present disclosure is not limited to the contents described in the following embodiments. Each component described below includes those which can be easily conceived by persons skilled in the art and those which are substantially equivalent. Further, the components described below may be combined appropriately. The disclosure herein is presented by way of example only, and the appended claims are to be construed as embodying appropriate modifications that may easily occur to persons skilled in the art within the basic teaching herein set forth. Further, in the drawings, a width, a thickness, a form, and the like of each component may be schematic as compared to actual embodiments, but this is done for simplicity of explanation and by way of example, and the present invention is not thus limited. Furthermore, the same components described in different embodiments and drawings may be denoted by the same reference numerals and symbols and detailed explanation thereof may be omitted appropriately.

Configuration of Display Device

Figure 2:
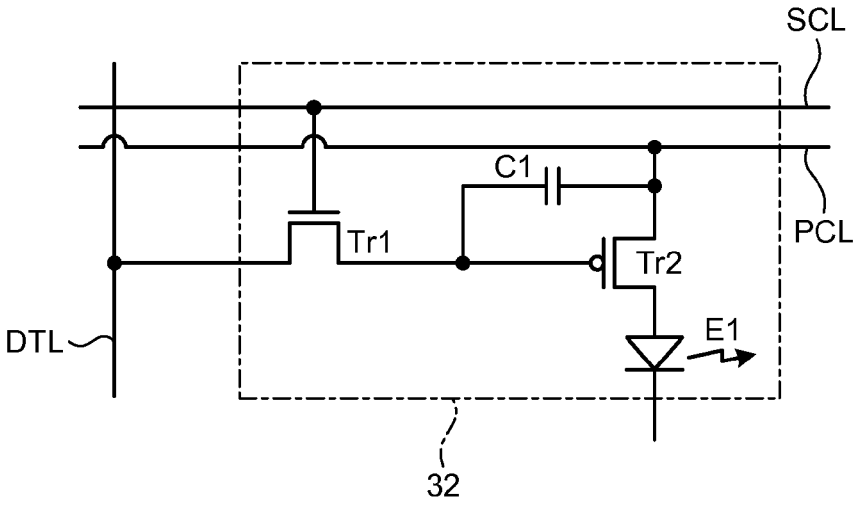
FIG. 2 is a diagram illustrating a lighting drive circuit of a sub-pixel included in a pixel of an image display unit according to the embodiment.
Figure 3:
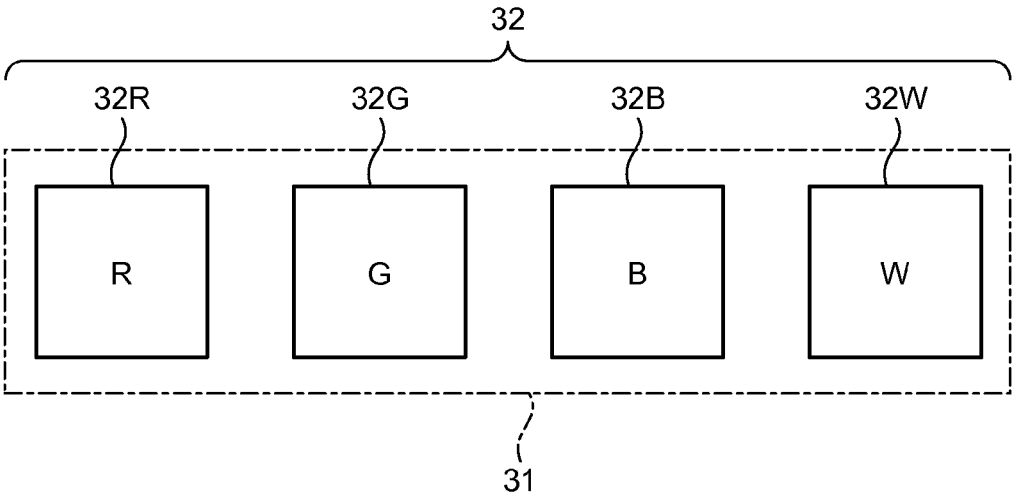
FIG. 3 is a diagram illustrating arrangement of sub-pixels of the image display unit according to the embodiment.
Figure 4:
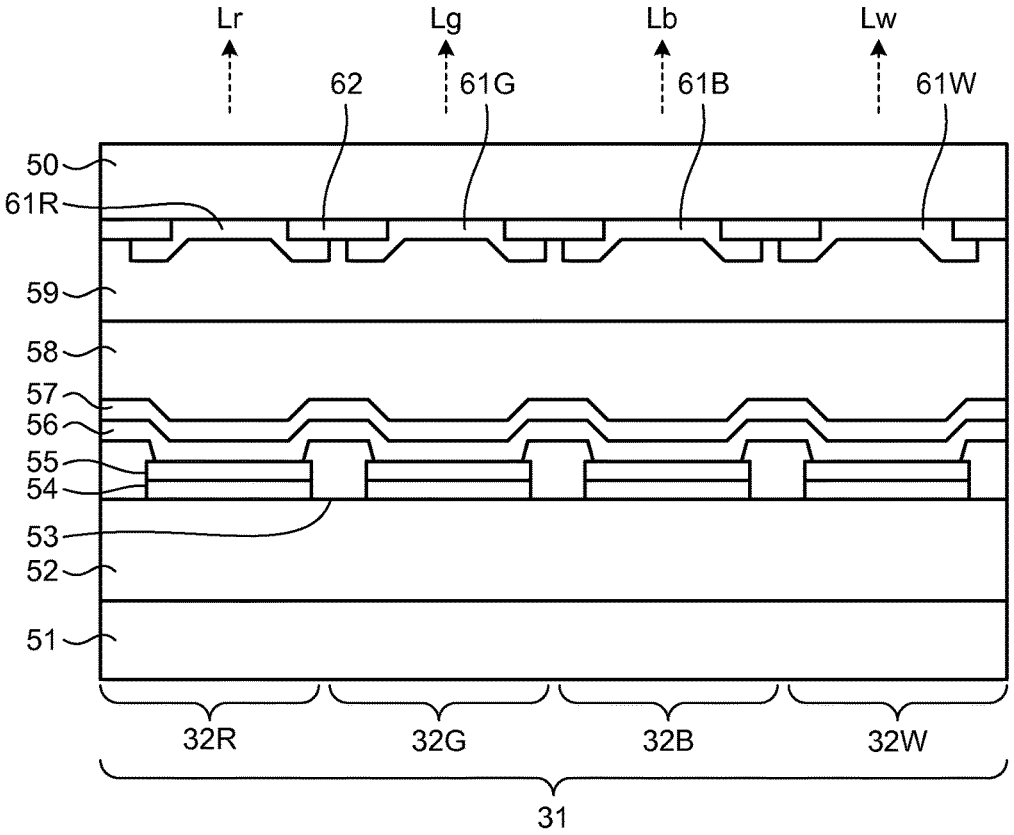
FIG. 4 is a cross-sectional view for explaining a structure of the image display unit according to the embodiment.
Figure 5:
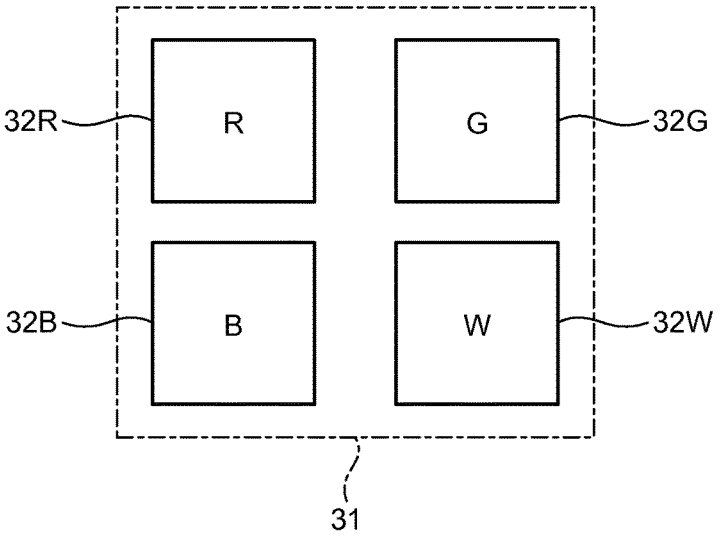
FIG. 5 is a diagram illustrating arrangement of the sub-pixels of the image display unit according to the embodiment.

FIG. 1 is a block diagram illustrating an example of a configuration of a display device according to an embodiment. FIG. 2 is a diagram illustrating a lighting drive circuit of a sub-pixel included in a pixel of an image display unit according to the embodiment. FIG. 3 is a diagram illustrating arrangement of sub-pixels of the image display unit according to the embodiment. FIG. 4 is a cross-sectional view for explaining a structure of the image display unit according to the embodiment. FIG. 5 is a diagram illustrating arrangement of the sub-pixels of the image display unit according to the embodiment.

As illustrated in FIG. 1, a display device 100 includes a conversion processing unit 10, a fourth sub-pixel signal processing unit 20, an image display unit 30 that is an image display panel, and an image display panel drive circuit 40 (hereinafter, also referred to as the drive circuit 40) that controls drive of the image display unit 30. The functions of the conversion processing unit 10 and the fourth sub-pixel signal processing unit 20 may be implemented by, but not limited to, hardware and/or software. When circuits of each of the conversion processing unit 10 and the fourth sub-pixel signal processing unit 20 are configured by hardware, the circuits need not be physically distinguished and isolated from each other, and a plurality of functions may be implemented by a physically single circuit. As will be described below in a third embodiment, it may be possible to provide an external information unit 101 that measures illuminance of external light or the like and inputs information on the outside of the display device. Alternatively, the display device 100 may acquire information on illuminance of external light from the external information unit 101 provided outside the display device 100 and may input the illuminance to the conversion processing unit 10.

The conversion processing unit 10 receives a first input signal SRGB1 including first color information that is obtained based on an input video signal from an image output unit 12 of a control device 11 and that is used for display at a predetermined pixel. The conversion processing unit 10 outputs a second input signal SRGB2, in which the first color information that is an input value in an HSV color space is converted to second color information such that a saturation is reduced by an amount of saturation attenuation within a range of acceptable saturation variation. Each of the first color information and the second color information is a three-color input signal (R, G, B) including a red component (R), a green component (G), and a blue component (B).

The fourth sub-pixel signal processing unit 20 is coupled to the image display panel drive circuit 40 that drives the image display unit 30. For example, the fourth sub-pixel signal processing unit 20 converts an input value of an input signal (the second input signal SRGB2) in the input HSV color space to a reproduced value (a third input signal SRGBW) in the HSV color space reproduced with a first color, a second color, a third color, and a fourth color to generate an output signal, and outputs the generated output signal to the image display unit 30. In this manner, the fourth sub-pixel signal processing unit 20 outputs, to the drive circuit 40, the third input signal SRGBW including third color information with a red component (R), a green component (G), a blue component (B), and an additional color component such as a white component (W) that are converted based on the second color information in the second input signal SRGB2. The third color information is a four-color input signal (R, G, B, W). While an example will be described in which the additional color component is a white component of so-called pure white represented by (R, G, B)=(255, 255, 255) assuming that each of the red component (R), the green component (G), and the blue component (B) has 256 gradations, the embodiment is not thus limited. For example, it may be possible to perform conversion to the additional color component such as a fourth sub-pixel with a color component represented by (R, G, B)=(255, 230, 204).

In the embodiment, a process of converting an input signal (for example, RGB) to the HSV space is described above as an example of the conversion process; however, the embodiment is not thus limited, and other coordinate systems, such as an XYZ space and a YUV space, may be employed. A color gamut of sRGB or Adobe (registered trademark) RGB, which is a color gamut of a display, is represented by a triangular range in the xy chromaticity range of the XYZ color system; however, a predetermined color space that defines a specific color gamut is not limited to those defined by the triangular range and may be defined by a range corresponding to an arbitrary shape, such as a polygonal shape.

The fourth sub-pixel signal processing unit 20 outputs the generated output signal to the image display panel drive circuit 40. The drive circuit 40 is a control device of the image display unit 30 and includes a signal output circuit 41, a scanning circuit 42, and a power source circuit 43. The drive circuit 40 of the image display unit 30 holds, by the signal output circuit 41, the third input signal SRGBW including the third color information, and sequentially outputs the signal to each of pixels 31 of the image display unit 30. The signal output circuit 41 is electrically coupled to the image display unit 30 via a signal line DTL. The drive circuit 40 of the image display unit 30 selects, by the scanning circuit 42, a sub-pixel in the image display unit 30, and controls ON and OFF of a switching element (for example, thin film transistor (TFT)) to control operation of the sub-pixel (light transmittance). The scanning circuit 42 is electrically coupled to the image display unit 30 via a scanning line SCL. The power source circuit 43 supplies power to a self-emitting element of each of the pixels 31 (to be described below) via a power line PCL.

As the display device 100, various modifications described in Japanese Patent No. 3167026, Japanese Patent No. 3805150, Japanese Patent No. 4870358, Japanese Patent Application Laid-open Publication No. 2011-90118, and Japanese Patent Application Laid-open Publication No. 2006-3475 are applicable.

As illustrated in FIG. 1, the image display unit 30 includes the pixels 31, which are $P_0 \times Q_0$ pixels ($P_0$ pixels in the row direction and $Q_0$ pixels in the column direction) arrayed in a two-dimensional matrix form (matrix array).

Each of the pixels 31 includes a plurality of sub-pixels 32, and lighting drive circuits of the respective sub-pixels 32 illustrated in FIG. 2 are arrayed in a two-dimensional matrix form (matrix array). The lighting drive circuit includes a control transistor Tr1, a drive transistor Tr2, and a charge storage capacitor C1. A gate, a source, and a drain of the control transistor Tr1 are coupled to the scanning line SCL, the signal line DTL, and a gate of the drive transistor Tr2, respectively. One end of the charge storage capacitor C1 is coupled to the gate of the drive transistor Tr2 and the other end is coupled to a source of the drive transistor Tr2. The source of the drive transistor Tr2 is coupled to the power line PCL, and a drain of the drive transistor Tr2 is coupled to an anode of an organic light-emitting diode E1 that is a self-emitting element. A cathode of the organic light-emitting diode E1 is coupled to, for example, a reference potential point (for example, ground).

In FIG. 2, an example is illustrated in which the control transistor Tr1 is an n-channel transistor and the drive transistor Tr2 is a p-channel transistor; however, the polarities of the transistors are not thus limited. The polarities of the control transistor Tr1 and the drive transistor Tr2 may be determined as appropriate.

As illustrated in FIG. 3, each of the pixels 31 includes, for example, a first sub-pixel 32R, a second sub-pixel 32G, a third sub-pixel 32B, and a fourth sub-pixel 32W. The first sub-pixel 32R displays a first primary color (for example, a red-color (R) component). The second sub-pixel 32G displays a second primary color (for example, a green-color (G) component). The third sub-pixel 32B displays a third primary color (for example, a blue-color (B) component). The fourth sub-pixel 32W displays, as an additional color component, a fourth color (specifically, white color) different from the first primary color, the second primary color, and the third primary color. In the following, the first sub-pixel 32R, the second sub-pixel 32G, the third sub-pixel 32B, and the fourth sub-pixel 32W may be referred to as the sub-pixels 32 when they need not be distinguished from one another.

The image display unit 30 includes a substrate 51, insulating layers 52, 53, a reflecting layer 54, a lower electrode 55, a self-emitting layer 56, an upper electrode 57, an insulating layer 58, an insulating layer 59, color filters 61R, 61G, 61B, 61W as color conversion layers, a black matrix 62 as a shielding layer, and a substrate 50 (see FIG. 4). The substrate 51 may be a semiconductor substrate made of silicon or the like, a glass substrate, a resin substrate, or the like. The above described lighting drive circuit or the like is formed or mounted on the substrate 51. The insulating layer 52 is a protection layer for protecting the above described lighting drive circuit or the like, and may be made of silicon oxide, silicon nitride, or the like. The lower electrode 55 is provided at each of the first sub-pixel 32R, the second sub-pixel 32G, the third sub-pixel 32B, and the fourth sub-pixel 32W, and is a conductor that serves as the anode (positive electrode) of the above described organic light-emitting diode E1. The lower electrode 55 is a transparent electrode made of a transparent conductive material (transparent conductive oxide), such as Indium Tin Oxide (ITO). The insulating layer 53 is an insulating layer called a bank that partitions the first sub-pixel 32R, the second sub-pixel 32G, the third sub-pixel 32B, and the fourth sub-pixel 32W from one another. The reflecting layer 54 is made of a shiny metal material, such as silver, aluminum, or gold, which can reflect light emitted from the self-emitting layer 56. The self-emitting layer 56 includes an organic material, and includes a hole injection layer, a hole transport layer, a light-emitting layer, an electron transport layer, and an electron injection layer (not illustrated).

Hole Transport Layer

As a layer for generating holes, it is preferable to employ, for example, a layer containing an aromatic amine compound and a substance with electron acceptability to the aromatic amine compound. The aromatic amine compound is a substance having an arylamine skeleton. Among the aromatic amine compounds, an aromatic amine compound containing triphenylamine in the skeleton and having a molecular weight of 400 or greater is much preferable. Among the aromatic amine compounds containing triphenylamine in the skeletons, an aromatic amine compound containing condensed aromatic ring, such as naphthyl, in the skeleton is much preferable. With use of the aromatic amine compound containing triphenylamine and condensed aromatic ring, it becomes possible to improve heat resistance of a self-emitting element. Examples of the aromatic amine compound include, but are not limited to, 4-4'-bis[N-(1-naphthyl)-N-phenylamino]biphenyl (i.e., α-NPD), 4-4'-bis[N-(3-methylphenyl)-N-phenylamino]biphenyl (i.e., TPD), 4,4',4"-tris(N, N-diphenylamino)triphenylamine (i.e., TDATA), 4,4',4"-tris[N-(3-methylphenyl)-N-phenylamino) triphenylamine (i.e., MTDATA), 4-4'-bis[N-{4-(N, N-di-m-tolylamino)phenyl}-N-phenylamino]biphenyl (i.e., DNTPD), 1,3,5-tris[N, N-di(m-tolyl)-animo]benzene (i.e., m-MTDAB), 4,4' 4"-tris(N-carbazolyl)triphenylamine (i.e., TCTA), 2-3-bis(4-diphenylaminophenyl) quinoxaline (i.e., TPAQn), 2,2',3,3"-tetrakis(4-diphenylaminophenyl)-6,6'-bisquinoxaline (i.e., D-TriPhAQn), and 2-3-bis{4-[N-(1-naphthyl)-N-phenylamino]phenyl}-dibenzo[f,h]quinoxaline (i.e., NPADiBzQn). The substance with the electron acceptability to the aromatic amine compound is not specifically limited, and examples thereof include, but are not limited to, molybdenum oxide, vanadium oxide, 7,7,8,8-tetracyanoquinodimethane (TCNQ), and 2,3,5,6-tetrafluoro-7,7,8,8-tetracyanoquinodimethane (F4-TCNQ).

Electron Injection Layer and Electron Transport Layer

An electron transport substance is not specifically limited, and examples thereof include, but are not limited to, metal complex, such as tris(8-hydroxyquinolinato)aluminum (i.e., $Alq_3$), tris(4-methyl-8-hydroxyquinolinato)aluminum (i.e., $Almq_3$), bis(10-hydroxybenzo[h]quinolinato)beryllium (i.e., $BeBq_2$), bis(2-methyl-8-hydroxyquinolinato)-4-phenylphenolato-aluminum (i.e., BAlq), bis[2-(2-hydroxyphenyl)benzoxazolato]zinc ($Zn(BOX)_2$), or bis[2-(2-hydroxyphenyl) benzothiazolate]zinc ($Zn(BTZ)_2$), as well as 2-(4-biphenyl)-5-(4-tert-butylphenyl)-1,3,4-oxydiazole (i.e., PBD), 1,3-bis[5-(p-tert-butylphenyl)-1,3,4-oxydiazole-2-yl]benzene (i.e., OXD-7), 3-(4-tert-butylphenyl)-4-phenyl-5-(4-biphenylyl)-1,2,4-triazole (i.e., TAZ), 3-(4-tert-butylphenyl)-4-(4-ethylphenyl)-5-(4-biphenylyl)-1,2,4-triazole (i.e., p-EtTAZ), bathophenanthroline (i.e., BPhen), and bathocuproin (i.e., BCP). A substance with electron-donating ability to the electron transport substance is not specifically limited, and examples thereof include, but are not limited to, alkali metal, such as lithium or cesium; alkali earth metal, such as magnesium or calcium; and rare earth metal, such as erbium or ytterbium. It may be possible to employ, as the substance with the electron-donating ability to the electron transport substance, a substance selected from alkali metal oxide such as lithium oxide ($Li_2O$) or alkali earth metal oxide such as calcium oxide (CaO), sodium oxide ($Na_2O$), potassium oxide ($K_2O$), or magnesium oxide (MgO).

Light-Emitting Layer

To obtain, for example, reddish light, it may be possible to employ a substance having an emission spectrum with a peak at 600 nm to 680 nm. Examples of such a substance include, but are not limited to, 4-dicyanomethylene-2-isopropyl-6-[2-(1,1,7,7-tetramethyljulolidine-9-yl)ethenyl]-4H-pyran (i.e., DCJTI), 4-dicyanomethylene-2-methyl-6-[2-(1,1,7,7-tetramethyljulolidine-9-yl)ethenyl]-4H-pyran (i.e., DCJT), 4-dicyanomethylene-2-tert-butyl-6-[2-(1,1,7,7-tetramethyljulolidine-9-yl)ethenyl]-4H-pyran (i.e., DCJTB), periflanthene, and 2,5-dicyano-1,4-bis[2-(10-methoxy-1,1,7,7-tetramethyljulolidine-9-yl)ethenyl]benzene. To obtain greenish light, it may be possible to employ a substance having an emission spectrum with a peak at 500 nm to 550 nm. Examples of such a substance include, but are not limited to, N,N'-dimethylquinacridone (i.e., DMQd), coumalin6, coumalin545T, and tris(8-hydroxyquinolinato)aluminum (i.e., $Alq_3$). To obtain bluish light, it may be possible to employ a substance having an emission spectrum with a peak at 420 nm to 500 nm. Examples of such a substance include, but are not limited to, 9,10-bis(2-naphthyl)-tert-butylanthracene (i.e., t-BuDNA), 9,9'-bianthryl, 9,10-diphenylanthracene (i.e., DPA), 9,10-bis(2-naphthyl)anthracene (i.e., DNA), bis(2-methyl-8-hydroxyquinolinato)-4-phenylphenolato-gallium (i.e., BGaq), and bis(2-methyl-8-hydroxyquinolinato)-4-phenylphenolato-aluminum (i.e., BAlq). Other than the substance that emits fluorescence as described above, a substance that emits phosphorescence may be employed as the light-emitting substance. Examples of such a substance include, but are not limited to, bis[2-(3,5-bis(trifluoromethyl)phenyl)pyridinato-N,C2']iridium(III)picolinate (i.e., $Ir(CF_3ppy)_2(pic)$), bis[2-(4,6-difluorophenyl)pyridinato-N,C2']iridium(III)acetylacetonate (i.e., FIr(acac)), bis[2-(4,6-difluorophenyl)pyridinato-N,C2']iridium(III)picolinate (i.e., FIr(pic)), and tris(2-phenylpyridinato-N,C2')iridium (i.e., $Ir(ppy)_3$).

The upper electrode 57 is a transparent electrode made of a transparent conductive material (transparent conductive oxide), such as Indium Tin Oxide (ITO). In the embodiment, ITO is described as an example of the transparent conductive material; however, the embodiment is not thus limited. As the transparent conductive material, a conductive material with different composition, such as Indium Zin Oxide (IZO), may be used. The upper electrode 57 serves as the cathode (negative electrode) of the organic light-emitting diode E1. The insulating layer 58 is a sealing layer that seals the above described upper electrode 57, and may be made of silicon oxide, silicon nitride, or the like. The insulating layer 59 is a planarizing layer that suppresses steps formed by the bank, and may be made of silicon oxide, silicon nitride, or the like. The substrate 50 is a transparent substrate that protects the entire image display unit 30, and may be, for example, a glass substrate.

In FIG. 4, an example is illustrated in which the lower electrode 55 serves as the anode (positive electrode) and the upper electrode 57 serves as the cathode (negative electrode); however, the embodiment is not thus limited. The lower electrode 55 may serve as the cathode and the upper electrode 57 may serve as the anode, and in this case, it is possible to appropriately change the polarity of the drive transistor Tr2 electrically coupled to the lower electrode 55, and it is also possible to appropriately change the stacking order of the carrier injection layer (the hole injection layer and the electron injection layer), the carrier transport layer (the hole transport layer and the electron transport layer), and the light-emitting layer.

The image display unit 30 is a color display panel, and includes, as illustrated in FIG. 4, the first color filter 61R arranged between the first sub-pixel 32R and an image observer in order to transmit first primary color light Lr among light-emitting components of the self-emitting layer 56. The image display unit 30 includes, similarly to the above, the second color filter 61G arranged between the second sub-pixel 32G and the image observer in order to transmit second primary color light Lg among the light-emitting components of the self-emitting layer 56. The image display unit 30 includes, similarly to the above, the third color filter 61B arranged between the third sub-pixel 32B and the image observer in order to transmit third primary color light Lb among the light-emitting components of the self-emitting layer 56. Similarly to the above, the fourth color filter 61W is arranged between the fourth sub-pixel 32W and the image observer in order to transmit a light-emitting component that is adjusted as fourth primary color light Lw among the light-emitting components of the self-emitting layer 56. The image display unit 30 can emit, from the fourth sub-pixel 32W, the fourth primary color light Lw with a color component different from those of the first primary color light Lr, the second primary color light Lg, and the third primary color light Lb. The color filter may not be provided between the fourth sub-pixel 32W and the image observer, and the image display unit 30 may emit, from the fourth sub-pixel 32W, the fourth primary color light Lw with a color component different from those of the first primary color light Lr, the second primary color light Lg, and the third primary color light Lb without causing a light-emitting component of the self-emitting layer 56 to pass through a color conversion layer, such as the color filter. For example, the image display unit 30 may include, at the fourth sub-pixel 32W, a transparent resin layer instead of the fourth color filter 61W for color adjustment. If the image display unit 30 includes the transparent resin layer as described above, it becomes possible to prevent large steps from being formed at the fourth sub-pixel 32W.

FIG. 5 is a diagram illustrating another arrangement of the sub-pixels of the image display unit according to the embodiment. In the image display unit 30, the pixels 31 are arrayed in a matrix form, in each of which the sub-pixels 32 including the first sub-pixel 32R, the second sub-pixel 32G, the third sub-pixel 32B, and the fourth sub-pixel 32W are combined in a 2-by-2 matrix.

Figure 6:
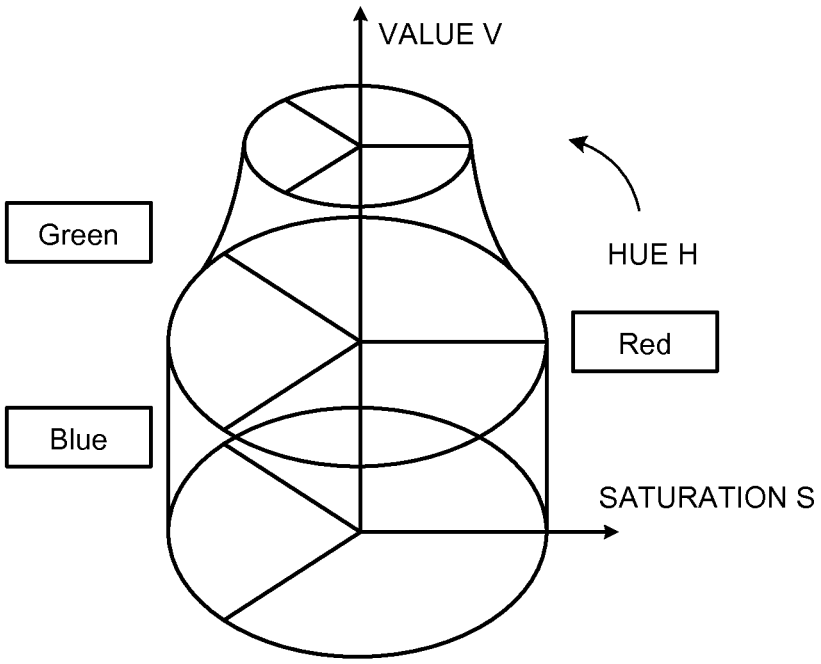
FIG. 6 is a conceptual diagram of an HSV color space that is reproducible by the display device of the embodiment.
Figure 7:
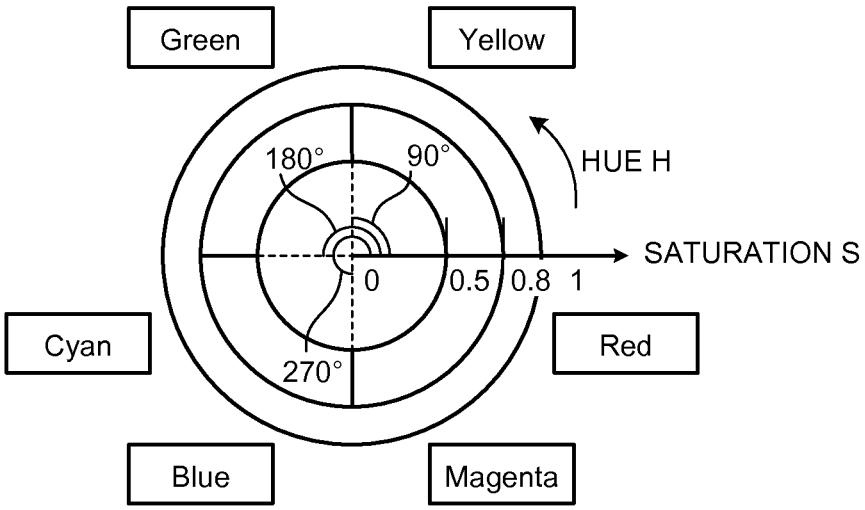
FIG. 7 is a conceptual diagram illustrating a relationship between a hue and a saturation in the HSV color space.

FIG. 6 is a conceptual diagram of the HSV color space that is reproducible by the display device of the embodiment. FIG. 7 is a conceptual diagram illustrating a relationship between a hue and a saturation in the HSV color space. The display device 100 includes, in each of the pixels 31, the fourth sub-pixel 32W for outputting the fourth color (white color); therefore, a dynamic range of the value (also called as brightness) in the HSV color space can be extended as illustrated in FIG. 6. That is, as illustrated in FIG. 6, a certain shape is obtained, in which a substantially trapezoidal solid indicating that the maximum value of a value V increases with an increase in a saturation S is placed on the cylindrical HSV color space that is representable by the first sub-pixel 32R, the second sub-pixel 32G, and the third sub-pixel 32B.

The first input signal SRGB1 includes, as the first color information, input signals of the respective gradations of the red component (R), the green component (G), and the blue component (B), and therefore serves as information on the cylindrical HSV color space, that is, a cylindrical portion of the HSV color space illustrated in FIG. 6.

As illustrated in FIG. 7, a hue H is represented by an angle from zero degree to 360 degrees. Red color (Red), yellow color (Yellow), green color (Green), cyan color (Cyan), blue color (Blue), magenta color (Magenta), and red color are arranged in this order from zero degree to 360 degrees. In the embodiment, a region including the angle of zero degree represents red, a region including the angle of 120 degrees represents green, and a region including the angle of 240 degrees represents blue.

First Embodiment

Figure 8:
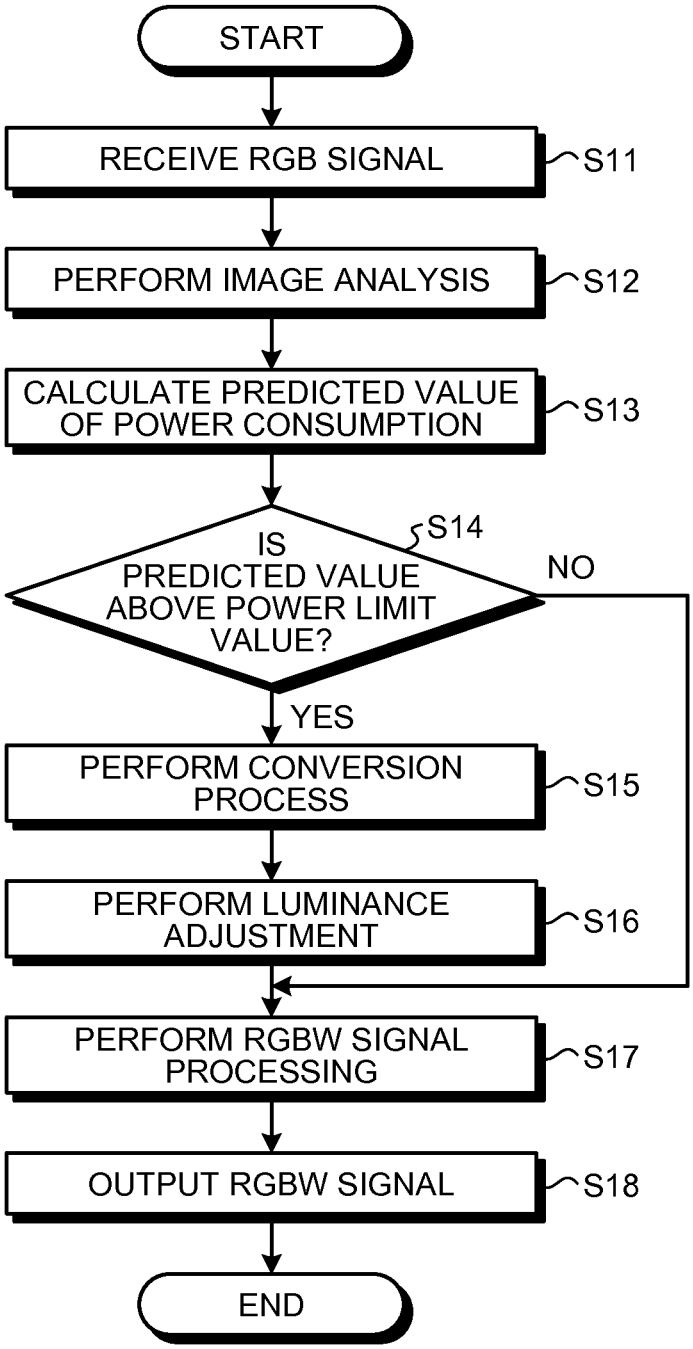
FIG. 8 is a flowchart for explaining a color conversion method according to a first embodiment.

FIG. 8 is a flowchart for explaining a color conversion method according to a first embodiment. As illustrated in FIG. 8, in the color conversion method on an input signal supplied to the image display unit, the conversion processing unit 10 receives the first input signal SRGB1 including the first color information that is obtained based on an input video signal and that is used for display at a predetermined pixel (Step S11). The first color information is subjected to gamma conversion as appropriate, and a value in the RGB coordinate system is converted to an input value in the HSV color space.

Subsequently, at an image analysis step, the conversion processing unit 10 performs an image analysis on the input video signal (Step S12). Alternatively, at the image analysis step at Step S12, the conversion processing unit 10 acquires image analysis information on the input video signal, which is calculated through other processes.

Figure 9:
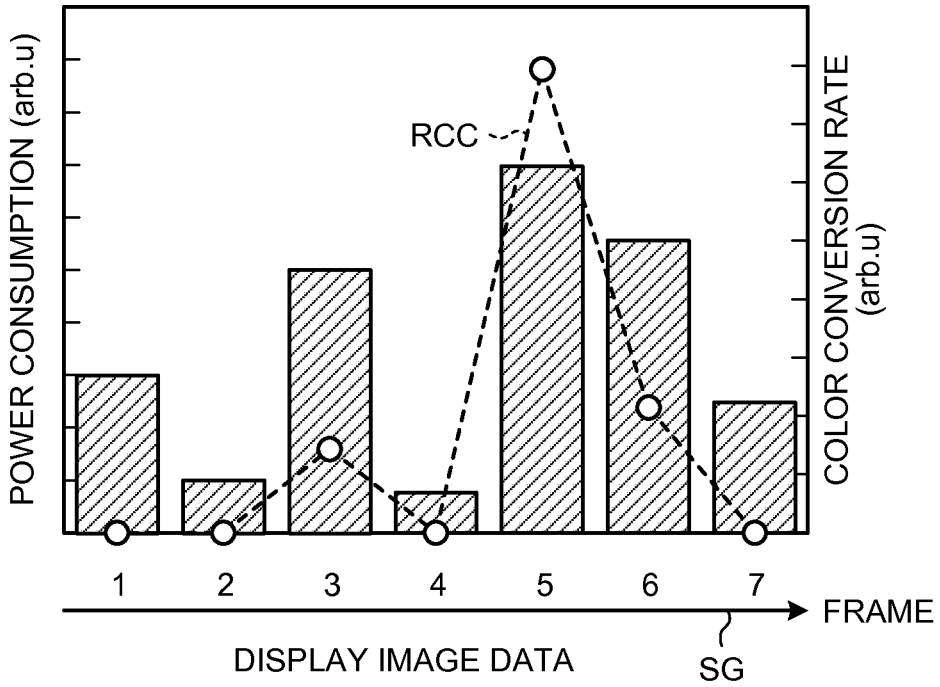
FIG. 9 is an explanatory diagram for explaining an increase and a decrease in a color conversion rate corresponding to a predicted value of power consumption per frame of display image data of an input video signal according to the first embodiment.
Figure 10:
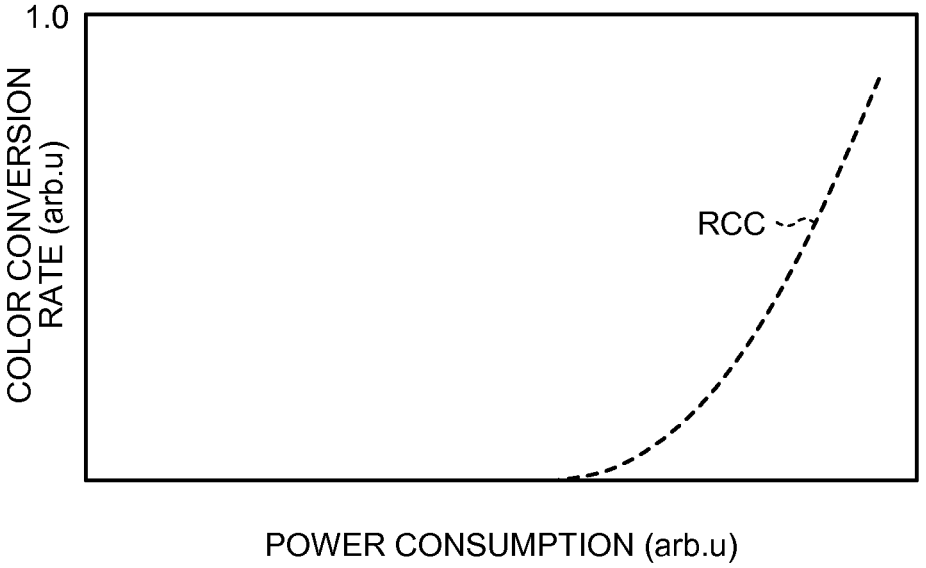
FIG. 10 is an explanatory diagram for explaining a look-up table indicating the color conversion rate corresponding to the predicted value of power consumption according to the first embodiment.

As a result of the image analysis on the input video signal, the conversion processing unit 10 calculates a predicted value of power consumption (Step S13). FIG. 9 is an explanatory diagram for explaining an increase and a decrease in a color conversion rate corresponding to the predicted value of power consumption per frame of display image data of an input video signal. FIG. 10 is an explanatory diagram for explaining a look-up table indicating the color conversion rate corresponding to the predicted value of power consumption according to the first embodiment. As described above, the first sub-pixel 32R displays the red component according to the amount of lighting of the self-emitting element. The second sub-pixel 32G displays the green component according to the amount of lighting of the self-emitting element. The third sub-pixel 32B displays the blue component according to the amount of lighting of the self-emitting element. The fourth sub-pixel 32W has a higher luminance or a higher power efficiency to display the additional color component (W) as compared to representation with the amount of lighting of the red component (R) displayed by the first sub-pixel 32R, the amount of lighting of the green component (G) displayed by the second sub-pixel 32G, and the amount of lighting of the blue component (B) displayed by the third sub-pixel 32B, and displays the additional color component according to the amount of lighting of the self-emitting element. Therefore, it is possible to obtain a power consumption by calculating a power consumption of a single frame, in which total amounts of lighting of the self-emitting elements of the first sub-pixels 32R, the second sub-pixels 32G, the third sub-pixels 32B, and the fourth sub-pixels 32W of all of the pixels are added from pieces of the first color information used for display at respective predetermined pixels based on the first input signal SRGB1 input at Step S11. Consequently, as illustrated in FIG. 9, the power consumption increases or decreases for each frame of each display image data SG of an input video signal.

The display device 100 stores therein, in advance, a power limit value as a setting value. As illustrated in FIG. 8, when the predicted value of power consumption is not above a threshold of the power limit value (NO at Step S14) the conversion processing unit 10 proceeds to Step S17. For example, as illustrated in FIG. 9, a predicted value of power consumption of each of frames 1, 2, 4, and 7 is not above the threshold of the power limit value, so that the color conversion rate is suppressed.

As illustrated in FIG. 8, if the predicted value of power consumption is above the threshold of the power limit value (YES at Step S14), the conversion processing unit 10 proceeds to Step S15. The conversion processing unit 10 stores therein, in advance, the look-up table indicating the color conversion rate corresponding to the predicted value of power consumption as illustrated in FIG. 10. The conversion processing unit 10 may store therein a conversion formula for calculating the color conversion rate corresponding to the predicted value of power consumption illustrated in FIG. 10. It is sufficient that the conversion processing unit 10 can calculate a relationship of the color conversion rate corresponding to the predicted value of power consumption and stores information on the color conversion rate corresponding to the predicted value of power consumption.

The conversion processing unit 10 according to the first embodiment calculates a color conversion rate RCC based on the predicted value of power consumption obtained at Step S13 and based on the information on the color conversion rate corresponding to the predicted value of power consumption illustrated in FIG. 10. Consequently, as illustrated in FIG. 9, the conversion processing unit 10 according to the first embodiment can calculate the color conversion rate RCC in accordance with the power consumption that increases or decreases for each frame of each display image data SG of an input video signal. For example, as illustrated in FIG. 9, a predicted value of power consumption of a frame 5 is above the threshold of the power limit value, so that it is necessary to increase the color conversion rate to maintain a desired luminance within the limited power consumption as illustrated in FIG. 10.

The conversion processing unit 10 according to the first embodiment performs at least one of a hue conversion step and a saturation conversion step in the conversion process (Step S15). The hue conversion step is a process of shifting the hue H of an original color by an amount of hue variation PRG, PGB, or PRB illustrated in FIG. 11 or less within a range in which a human being is less likely to notice the variation in the hue, such that the total amount of lighting of the light-emitting elements of the first sub-pixel 32R, the second sub-pixel 32G, the third sub-pixel 32B, and the fourth sub-pixel 32W is reduced.

Figure 11:
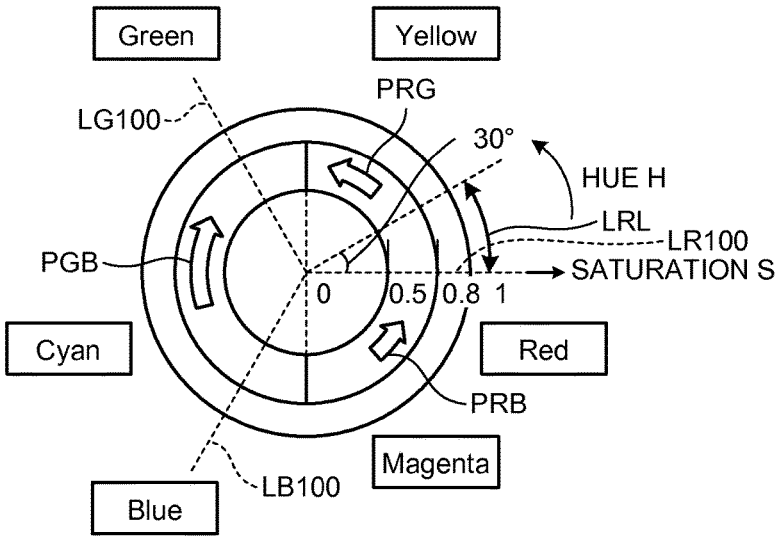
FIG. 11 is a conceptual diagram illustrating a hue conversion process in the HSV color space according to the first embodiment.
Figure 12:
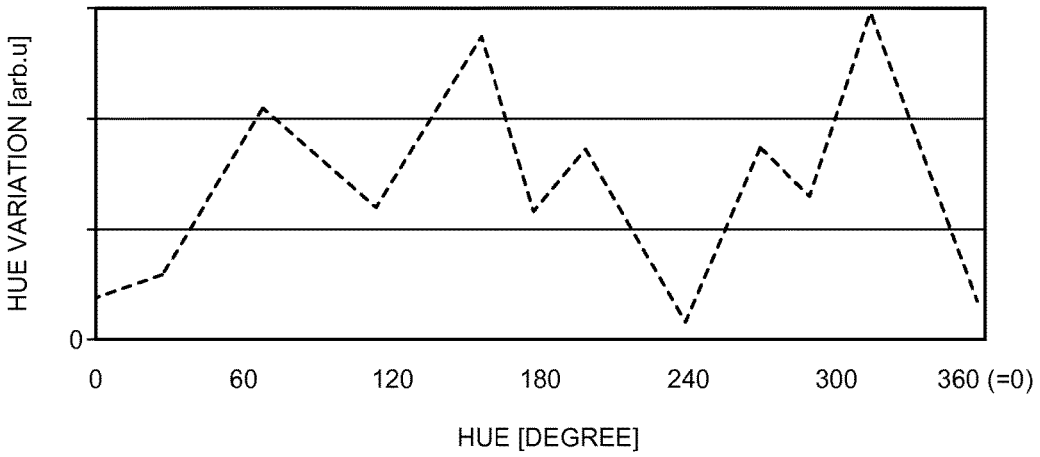
FIG. 12 is an explanatory diagram for explaining a look-up table indicating a relationship between an original hue before being converted according to the first embodiment and an amount of hue variation defined as a range of acceptable hue variation.

FIG. 11 is a conceptual diagram illustrating a hue conversion process in the HSV color space according to the first embodiment. FIG. 12 is an explanatory diagram for explaining a look-up table indicating a relationship between an original hue before being converted according to the first embodiment and an amount of hue variation defined as a range of acceptable hue variation.

As illustrated in FIG. 11, a region LRL with an angle from zero degree to 30 degrees (both inclusive) including a region LR100 placed at the angle of zero degree, as well as a region LB100 placed at the angle of 240 degrees are regions where the hue H can easily be recognized; therefore, it is preferable to set the amount of conversion of the hue H to a relatively small value. However, it has been found that, if the hue H at the angle of greater than 30 degrees and smaller than that of the region LG100 is shifted toward green (to approach the region LG100) by the amount of the hue variation PRG, it becomes possible to reduce power consumption and improve luminous efficiency. It has also been found that, if the hue H between the region LG100 and the region LB100 (both not inclusive) is shifted toward green (to approach the region LG100) by the amount of the hue variation PGB, it becomes possible to reduce power consumption and improve luminous efficiency. It has also been found that, if the hue H between the region LB100 and the region LR100 (both not inclusive) is shifted toward red (to approach the region LR100) by the amount of hue variation PRB, it becomes possible to reduce power consumption and improve luminous efficiency. Specifically, the luminance is higher in the order of green, red, and blue; therefore, if a hue of the second color information is converted toward a color with a higher luminance than a hue of the first color information, it becomes possible to reduce power consumption. Therefore, the conversion processing unit 10 according to the first embodiment stores therein information on the look-up table indicating the amount of hue variation with respect to the hue H as illustrated in FIG. 12, and calculates the amounts of the hue variation PRG, PGB, and PRB based on the look-up table illustrated in FIG. 12.

Figure 13:
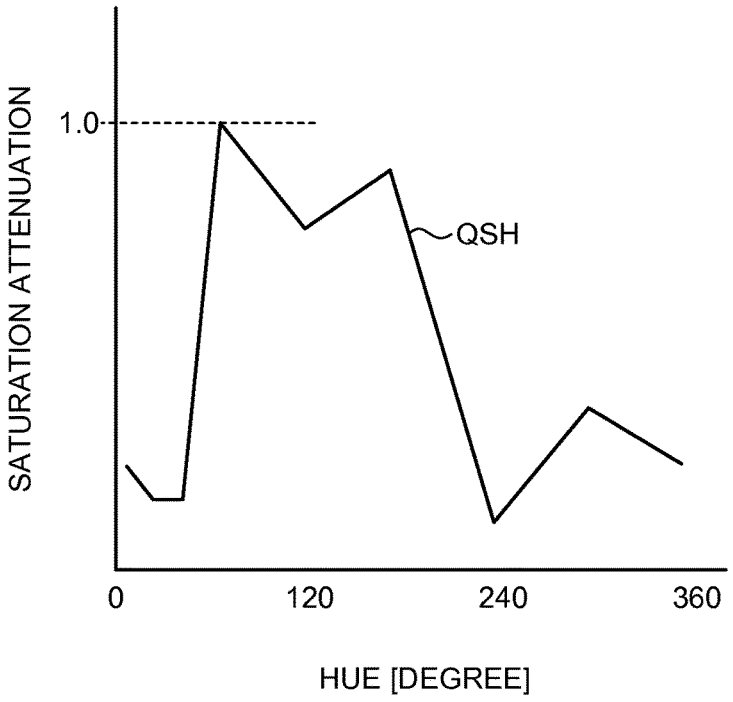
FIG. 13 is an explanatory diagram for explaining a look-up table indicating a relationship between a hue according to the embodiment and an amount of saturation attenuation within a predetermined range defined as a range of acceptable saturation variation.
Figure 14:
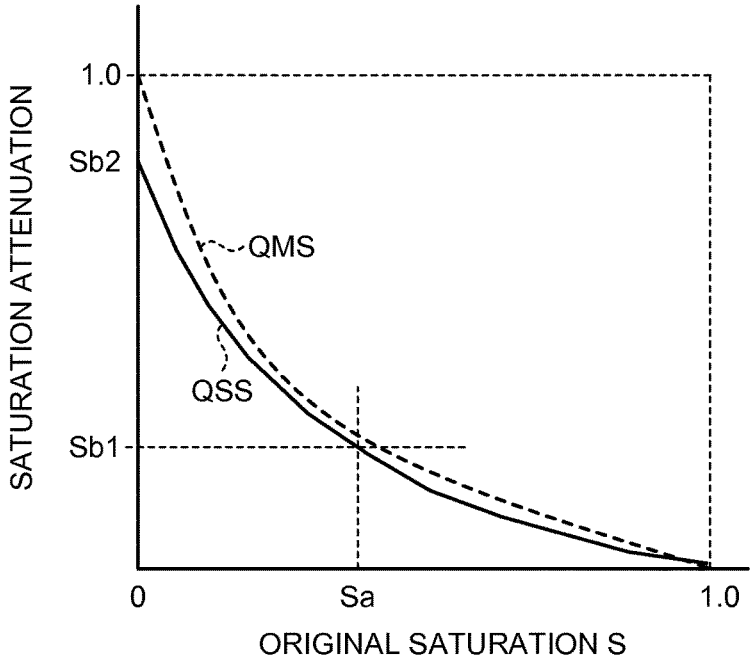
FIG. 14 is an explanatory diagram for explaining a look-up table indicating a relationship between an original saturation before being converted according to the embodiment and an amount of saturation attenuation within a predetermined range defined as a range of acceptable saturation variation.
Figure 15:
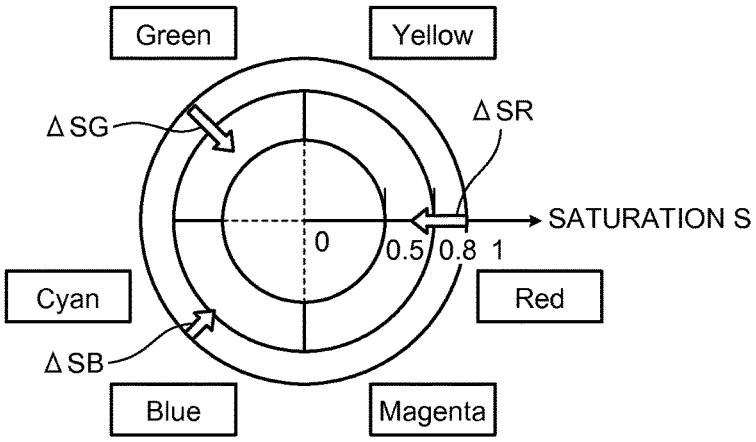
FIG. 15 is a conceptual diagram illustrating an amount of saturation attenuation in the HSV color space according to the embodiment.

At the saturation conversion step, a saturation (an original saturation S) of an original color is attenuated within a predetermined range defined as a range of acceptable saturation variation, to thereby increase the amount of lighting of the fourth sub-pixel 32W. The saturation (the original saturation S) of the original color is attenuated within the predetermined range defined as the range of acceptable saturation variation, to thereby reduce the total amount of lighting of the light-emitting elements of the first sub-pixel 32R, the second sub-pixel 32G, the third sub-pixel 32B, and the fourth sub-pixel 32W; therefore, it is possible to suppress the power consumption. Consequently, if the sub-pixels 32 that are not lighted among the first sub-pixel 32R, the second sub-pixel 32G, and the third sub-pixel 32B increase, the power consumption can further be suppressed. FIG. 13 is an explanatory diagram for explaining a look-up table indicating a relationship between a hue according to the embodiment and an amount of saturation attenuation within the predetermined range defined as the range of acceptable saturation variation. FIG. 14 is an explanatory diagram for explaining a look-up table indicating a relationship between an original saturation before being converted according to the embodiment and an amount of saturation attenuation within a predetermined range defined as a range of acceptable saturation variation. FIG. 15 is a conceptual diagram illustrating the amount of saturation attenuation in the HSV color space according to the embodiment.

As illustrated in FIG. 13, the amount of saturation attenuation within a predetermined range defined as a range of acceptable saturation variation varies for each hue H. The look-up table illustrated in FIG. 13 is first saturation conversion information, in which a gain value QSH is obtained assuming that the vertical axis represents the amount of saturation attenuation with respect to each hue H. As illustrated in FIG. 13, in the case of either the red component with the hue H in the region including the angle of zero degree and the blue component with the hue H in the region including the angle of 240 degrees, the amount of saturation attenuation within a predetermined range defined as a range of acceptable saturation variation is relatively small, so that the amount of saturation attenuation varied by the conversion processing unit 10 is relatively small. The first sub-pixel 32R displays the red component according to the amount of lighting of the self-emitting element. The second sub-pixel 32G displays the green component according to the amount of lighting of the self-emitting element. The third sub-pixel 32B displays the blue component according to the amount of lighting of the self-emitting element. The fourth sub-pixel 32W has a higher luminance than those of the first sub-pixel 32R, the second sub-pixel 32G, and the third sub-pixel 32B, and displays the additional color component according to the amount of lighting of the self-emitting element. Therefore, to suppress the power consumption, it is preferable that the hue of the second color information is shifted toward a color with a greater amount of the white component as compared to the hue of the first color information. Further, it is preferable that the hue of the second color information is shifted in a direction in which the number of lightings of the self-emitting elements of the first sub-pixel 32R, the second sub-pixel 32G, and the third sub-pixel 32B decreases such that the amount of lighting of the self-emitting element of at least one of the first sub-pixel 32R, the second sub-pixel 32G, and the third sub-pixel 32B is reduced as compared to the hue of the first color information. Alternatively, it is preferable that the hue of the second color information is shifted toward a color with a higher luminance than the hue of the first color information.

As illustrated in FIG. 14, the amount of saturation attenuation within a predetermined range defined as a range of acceptable saturation variation varies for each original saturation S. The look-up table illustrated in FIG. 14 is a plot of, as a recognition characteristic curve QMS, a curve of the lower limit value of the amount of saturation attenuation with which the variation in the saturation is recognized, with respect to the original saturation S that is not yet converted by the conversion processing unit 10. The conversion processing unit 10 stores therein, as the first saturation conversion information, an approximate curve QSS below the recognition characteristic curve QMS with respect to the same original saturation S. For example, the approximate curve QSS is stored so as to be below the entire recognition characteristic curve QMS of each of the primary color of the red component, the primary color of the green component, and the primary color of the blue component among the hues H. More specifically, for example, the approximate curve QSS is stored such that an amount of saturation attenuation Sb1 is obtained when the original saturation S is set to a saturation Sa and an amount of saturation attenuation Sb2 is obtained when the original saturation is set to zero. The approximate curve QSS may be stored as a function or a look-up table. Alternatively, the approximate curve QSS may be sequentially calculated within a range below the recognition characteristic curve QMS.

Subsequently, as illustrated in FIG. 15, the conversion processing unit 10 performs a saturation conversion step of calculating, based on information in the look-up tables in FIG. 13 and FIG. 14, a gain value of the amount of saturation attenuation such that the amount of saturation attenuation is regulated to any of amounts of saturation attenuation ΔSR, ΔSG, and ΔSB, and multiplying the first color information that is the input value in the HSV color space by the gain value. For example, the conversion processing unit 10 employs a gain value that is obtained by multiplying the look-up tables in FIG. 13 and FIG. 14. Accordingly, it becomes possible to obtain a highly accurate gain value for each hue H. For another example, the conversion processing unit 10 employs a gain value that is obtained by adding the look-up tables in FIG. 13 and FIG. 14. Accordingly, it becomes possible to reduce a load on the calculation in the conversion process. As described above, the first sub-pixel 32R displays the red component according to the amount of lighting of the self-emitting element. The second sub-pixel 32G displays the green component according to the amount of lighting of the self-emitting element. The third sub-pixel 32B displays the blue component according to the amount of lighting of the self-emitting element. The fourth sub-pixel 32W has a higher luminance or a higher power efficiency to display the additional color component (W) as compared to representation with the amount of lighting of the red component (R) displayed by the first sub-pixel 32R, the amount of lighting of the green component (G) displayed by the second sub-pixel 32G, and the amount of lighting of the blue component (B) displayed by the third sub-pixel 32B, and displays the additional color component according to the amount of lighting of the self-emitting element. Therefore, to suppress the power consumption, it is preferable that the hue of the second color information is shifted toward a color with a greater amount of the white component as compared to the hue of the first color information. As described above, an example of the color conversion method has been described, in which the hue conversion step is first performed and the saturation conversion step is subsequently performed; however, it may be possible to perform the hue conversion step after the saturation conversion step. In the color conversion method, it may be possible to perform one of the saturation conversion step and the hue conversion step. In the color conversion method, it may be possible to perform the hue conversion step and the saturation conversion step in parallel.

Figure 16:
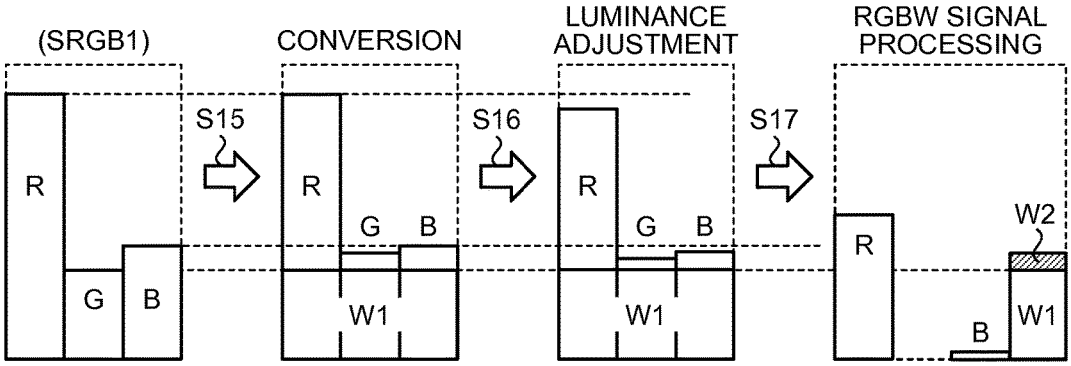
FIG. 16 is a schematic diagram for explaining an example of a color conversion process according to the first embodiment.
Figure 17:
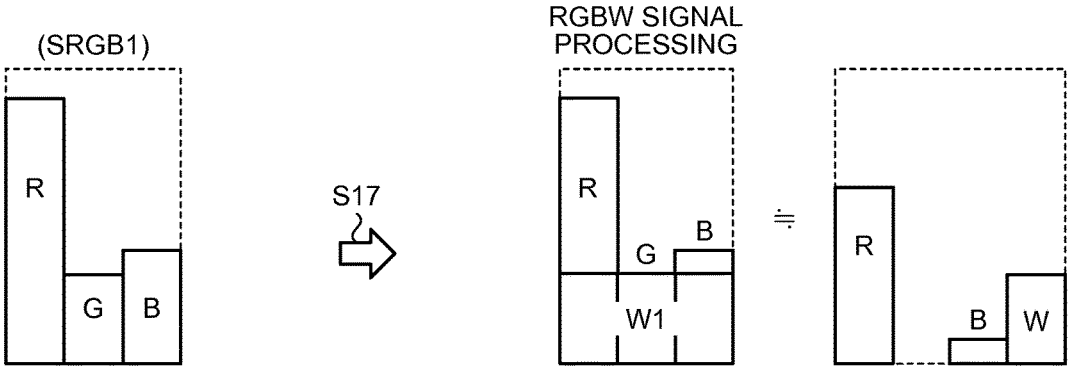
FIG. 17 is a schematic diagram for explaining an example of a color conversion process according to a comparative example.

FIG. 16 is a schematic diagram for explaining an example of the hue conversion process according to the first embodiment. FIG. 17 is a schematic diagram for explaining an example of a color conversion process according to a comparative example. For example, as illustrated in FIG. 16, when the first input signal SRGB1 including the first color information is converted to the second input signal SRGB2 including the converted second color information through a conversion processing step (Step S15), the amount of hue variation and the amount of saturation attenuation are calculated according to the above described color conversion rate RCC such that the green component (G) increases.

Accordingly, the amount of a white component W2 with all of the red component, the green component, and the blue component, each being a single color component, increases. When the fourth sub-pixel signal processing unit 20 performs the RGBW signal processing step of performing conversion to a reproduced value (the third input signal SRGBW) in the HSV color space reproduced with the first color, the second color, the third color, and the fourth color to generate an output signal, and outputting the generated signal to the image display unit 30 (Step S17), the amount of lighting of the red component (R) displayed by the first sub-pixel 32R and the amount of lighting of the additional color component (W1+W2), that is, white color, displayed by the fourth sub-pixel 32W correspond to the power consumption of the pixel 31.

As illustrated in FIG. 17, in the example of the color conversion process according to the comparative example, the RGBW signal processing step (Step S17) is performed without performing the saturation conversion step (Step S15); therefore, the amount of lighting of the red component (R) displayed by the first sub-pixel 32R, the amount of lighting of the blue component (B) displayed by the third sub-pixel 32B, and the amount of lighting of the additional color component (W1+W2), that is, white color, displayed by the fourth sub-pixel 32W correspond to the power consumption of the pixel 31. As described above, as compared to the process in the comparative example, the color conversion method on the input signal supplied to the image display unit according to the first embodiment can increase the amount of lighting of the additional color component (W1+W2), that is, white color, while reducing the amount of lighting of the single color component (for example, the blue component), enabling to suppress the power consumption of the pixel 31.

Subsequently, as illustrated in FIG. 8, the conversion processing unit 10 performs a luminance adjustment step of performing a calculation to reduce a saturation such that the luminance of the first color information and the luminance of the second color information remain substantially equal to each other (Step S16). For example, as illustrated in FIG. 16, the luminance of the second color information looks higher than the luminance of the first color information after the above described saturation conversion step (Step S15); therefore, the conversion processing unit 10 adjusts the luminance such that the luminance of the first color information and the luminance of the second color information remain substantially equal to each other.

As illustrated in FIG. 16, the level of each of the red component, the green component, and the blue component, each being a single color component, is uniformly reduced through the luminance adjustment process. Therefore, through the RGBW signal processing step (Step S17), the amount of lighting of the red component (R) displayed by the first sub-pixel 32R and the amount of lighting of the additional color component (W1+W2), that is, white color, displayed by the fourth sub-pixel 32W in the third input signal SRGBW are further reduced. Further, when a human being compares the first color information and the second color information, variation in the luminance is small, so that degradation of the entire image is less likely to be recognized.

As described above, the fourth sub-pixel signal processing unit 20 performs an output step of outputting, to the drive circuit 40 that controls drive of the image display unit 30, the third input signal SRGBW including the third color information with the red component (R), the green component (G), the blue component (B), and the additional color component such as the white component (W) that are converted based on the second color information in the second input signal SRGB2 (Step S18).

As described above, the display device 100 performs, for all of pixels, image analysis on the input video signal used for display at the predetermined pixel 31, and, if the predicted value of power consumption obtained as the total amount of lighting of the self-emitting elements is above the power limit value, outputs the second input signal that is obtained by performing the color conversion process on the first input signal SRGB1 including the first color information at the color conversion rate RCC associated with the predicted value of power consumption. Therefore, the amount of lighting of the fourth sub-pixel increases and the total amount of lighting of the light-emitting elements of the first sub-pixel 32R, the second sub-pixel 32G, the third sub-pixel 32B, and the fourth sub-pixel 32W decreases. Consequently, the display device 100 can suppress the power consumption and therefore can display the input video signal within the power limit. As a result, if the sub-pixels 32 that are not lighted among the first sub-pixel 32R, the second sub-pixel 32G, and the third sub-pixel 32B increase or if the amount of lighting decreases, the power consumption can further be suppressed.

In the image display unit 30, the original saturation S is attenuated such that the luminance of the first color information and the luminance of the second color information remain substantially equal to each other; therefore, degradation of an image is less likely to be recognized by a human being. Consequently, the display device 100 can suppress the entire power consumption while suppressing a decrease (degradation) in the entire display quality.

The conversion processing unit 10 reduces a saturation such that the amount of saturation attenuation varies according to the hue of the first color information. Therefore, the amount of saturation attenuation corresponding to a hue that is recognizable by a human being is small, so that degradation of an image is less likely to be recognized by a human being. Consequently, the display device 100 can suppress the entire power consumption while suppressing a decrease (degradation) in the entire display quality.

The conversion processing unit 10 performs a calculation to convert a hue such that the total amount of lighting of the self-emitting elements for the second color information is reduced relative to the first color information. Specifically, it is preferable to perform a calculation to convert a hue such that the total amount of lighting of the self-emitting elements for the second color information is reduced relative to the first color information, in accordance with a value obtained by subtracting a color component with the lowest luminance from a color component with the highest luminance among the red component, the green component, and the blue component contained in the first color information. Consequently, a balance of color shade is maintained. For example, if there is a deviation of the chromaticity of a green component according to an image analysis on all of the pixels, a hue is converted such that the total amount of lighting of the self-emitting elements for the second color information is reduced relative to the first color information, as compared to a case where there is no deviation in the green component. Consequently, the display device 100 can suppress the entire power consumption while suppressing a decrease (degradation) in the entire display quality.

According to the embodiment, it is possible to provide a display device and a color conversion method capable of suppressing power consumption in an image display unit that lights self-emitting elements.

Second Embodiment

Figure 18:
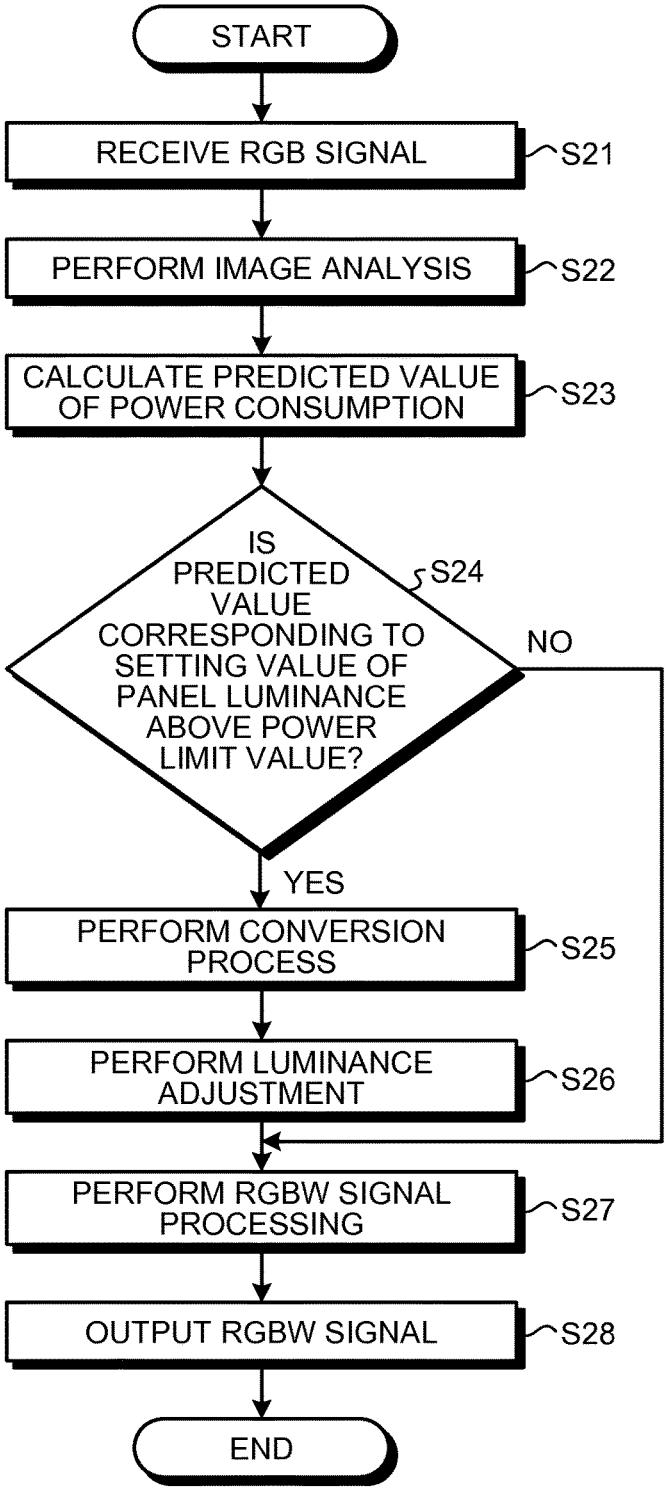
FIG. 18 is a flowchart for explaining a color conversion method according to a second embodiment.
Figure 19:
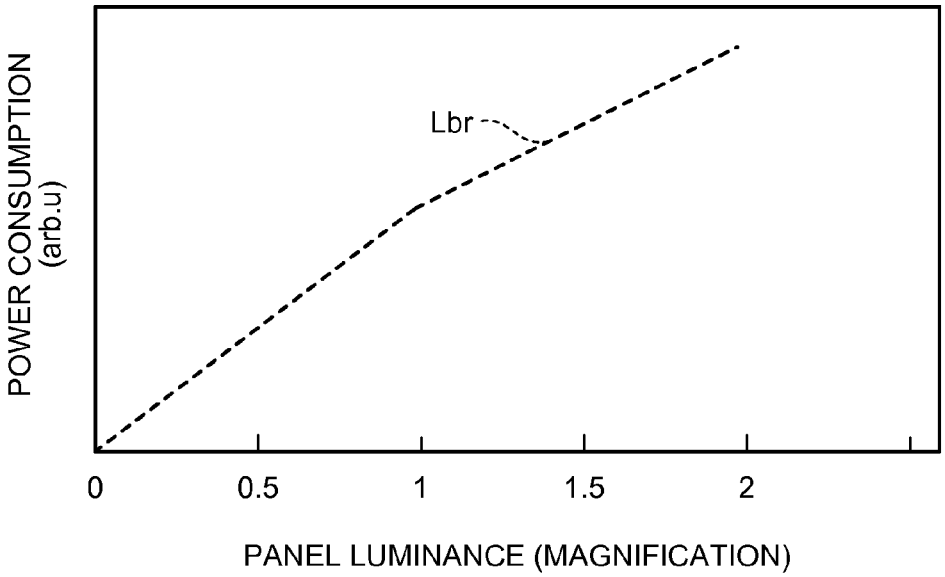
FIG. 19 is an explanatory diagram for explaining a look-up table indicating a correlation of a predicted value of power consumption with respect to a panel luminance according to the second embodiment.
Figure 20:
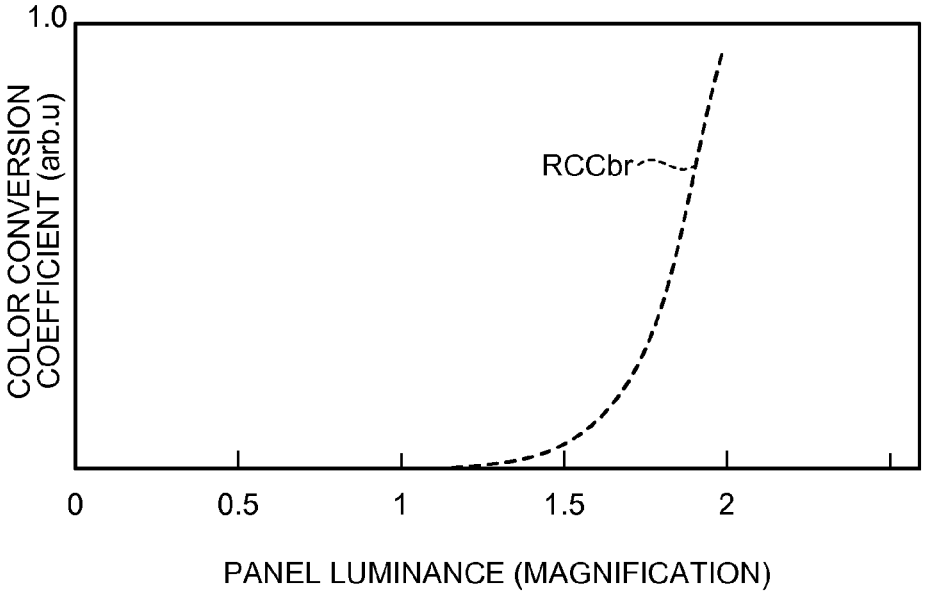
FIG. 20 is an explanatory diagram for explaining a look-up table indicating a color conversion coefficient corresponding to the panel luminance according to the second embodiment.
Figure 21:
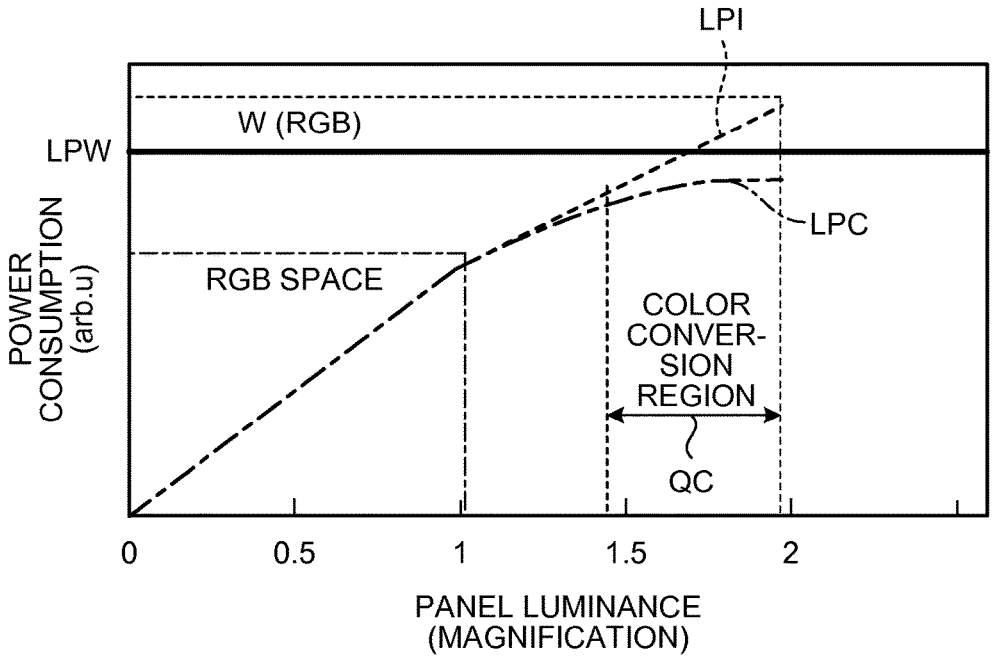
FIG. 21 is an explanatory diagram for explaining a state in which the predicted value of power consumption corresponding to a setting value of the panel luminance according to the second embodiment exceeds a power limit value.

FIG. 18 is a flowchart for explaining a color conversion method according to a second embodiment. FIG. 19 is an explanatory diagram for explaining a look-up table indicating a color conversion rate corresponding to a predicted value of power consumption according to the second embodiment. FIG. 20 is an explanatory diagram for explaining a look-up table indicating a color conversion coefficient corresponding to a panel luminance according to the second embodiment. FIG. 21 is an explanatory diagram for explaining a state in which a predicted value of power consumption corresponding to a setting value of the panel luminance according to the second embodiment exceeds a power limit value. The same components as those of the above described embodiment are denoted by the same reference numerals and symbols, and the same explanation will not be repeated.

The display device 100 according to the second embodiment includes, similarly to the display device 100 according to the above described first embodiment, the fourth sub-pixel 32W for outputting the fourth color (white color) in each of the pixels 31; therefore, a dynamic range of the value in the HSV color space can be extended as illustrated in FIG. 6. As a setting of a value of the image display unit 30, a setting value of a panel luminance is set and stored based on an input from an operator who operates the display device 100. For example, assuming that the maximum value that is representable in the cylindrical HSV color space displayed with the first sub-pixel 32R, the second sub-pixel 32G, and the third sub-pixel 32B corresponds to a magnification of 1 with respect to the panel luminance, and assuming that a horizontal axis represents the magnification of the panel luminance and a vertical axis represents a predicted value of power consumption per frame of display image data of an input video signal according to the second embodiment, a correlation curve Lbr of the power consumption and the panel luminance as illustrated in FIG. 19 is obtained. According to the correlation curve Lbr, if a magnification of the panel luminance greater than the maximum value that is displayable with the first sub-pixel 32R, the second sub-pixel 32G, and the third sub-pixel 32B is set (if the magnification of the panel luminance is greater than 1), power consumption increases and may exceed the threshold of the power limit value of the display device 100 depending on display image data of an input video signal.

Therefore, the display device 100 according to the second embodiment performs the color conversion method according to the second embodiment as illustrated in FIG. 18. In the color conversion method on the input signal supplied to the image display unit, the conversion processing unit 10 receives the first input signal SRGB1 including the first color information that is obtained based on an input video signal and that is used for display at a predetermined pixel (Step S21). The first color information is subjected to gamma conversion as appropriate, and a value in the RGB coordinate system is converted to an input value in the HSV color space.

Subsequently, at an image analysis step (Step S22), the conversion processing unit 10 performs an image analysis on the input video signal. Alternatively, at the image analysis step (Step S22), the conversion processing unit 10 acquires image analysis information on the input video signal, which is calculated through other processes.

As a result of the image analysis on the input video signal, the conversion processing unit 10 calculates a predicted value of power consumption (Step S23). The conversion processing unit 10 can calculate a predicted value of power consumption corresponding to the setting value of the panel luminance by multiplying a power consumption of a single frame, in which total amounts of lighting of the self-emitting elements of the first sub-pixels 32R, the second sub-pixels 32G, the third sub-pixels 32B, and the fourth sub-pixels 32W of all of the pixels are added from pieces of the first color information used for display at respective predetermined pixels based on the first input signal SRGB1 input at Step S21, by the above described correlation in the look-up table illustrated in FIG. 19.

As illustrated in FIG. 18, if the predicted value of power consumption corresponding to the setting value of the panel luminance is not above the threshold of the power limit value (NO at Step S24), the conversion processing unit 10 proceeds to Step S27.

As illustrated in FIG. 18, if the predicted value of power consumption is above the threshold of the power limit value (YES at Step S24), the conversion processing unit 10 proceeds to Step S25. The conversion processing unit 10 stores therein, in advance, a look-up table indicating, as the setting value of the panel luminance illustrated in FIG. 20, a correlation curve RCCbr of a color conversion coefficient corresponding to a panel magnification.

The conversion processing unit 10 according to the second embodiment calculates the color conversion rate RCC based on the predicted value of power consumption obtained at Step S23 and based on the information on the color conversion rate corresponding to the predicted value of power consumption illustrated in FIG. 10. Then, the conversion processing unit 10 according to the second embodiment multiplies the calculated color conversion rate RCC by the color conversion coefficient corresponding to the panel magnification as the setting value of the panel luminance illustrated in FIG. 20, to thereby correct the color conversion rate RCC. Consequently, the conversion processing unit 10 according to the second embodiment can calculate the color conversion rate RCC in accordance with the power consumption that increases or decreases for each frame of each display image data SG of an input video signal.

The conversion processing unit 10 according to the second embodiment performs at least one of the hue conversion step and the saturation conversion step at the conversion processing step (Step S25). The process from Step S25 to Step S28 is the same as the process from Step S15 to Step S18 according to the first embodiment, and therefore, explanation thereof will be omitted.

As described above, the conversion processing unit 10 calculates the predicted value of power consumption in accordance with the input setting value of the panel luminance. Therefore, the conversion processing unit 10 can perform the color conversion process on the input first input signal including the first color information by using the color conversion rate associated with the predicted value of power consumption. Consequently, as illustrated in FIG. 21, when a magnification of the panel luminance greater than the maximum value that is displayable with the first sub-pixel 32R, the second sub-pixel 32G, and the third sub-pixel 32B is set (when the magnification of the panel luminance is greater than 1), it becomes possible to suppress the possibility that power consumption LPI increases and may exceed the threshold of a power limit value LPW of the display device 100 depending on display image data of an input video signal, enabling to reduce power consumption LPC in a color conversion region QC. As a result, in the color conversion region QC, the power consumption LPI can remain below the threshold of the power limit value LPW.

The conversion processing unit 10 performs the color conversion process on an object to be a target of power restriction to be applied according to the predicted value of power consumption of pixels of a single frame. Therefore, it may be possible to selectively perform the conversion process such that the power consumption is reduced by performing color conversion on an input image which has a relatively high luminance and which is likely to be a target of the power restriction, and such that settings are maintained for other input images.

According to the embodiment, it is possible to provide a display device and a color conversion method capable of suppressing power consumption in an image display unit that lights self-emitting elements.

Third Embodiment

Figure 22:
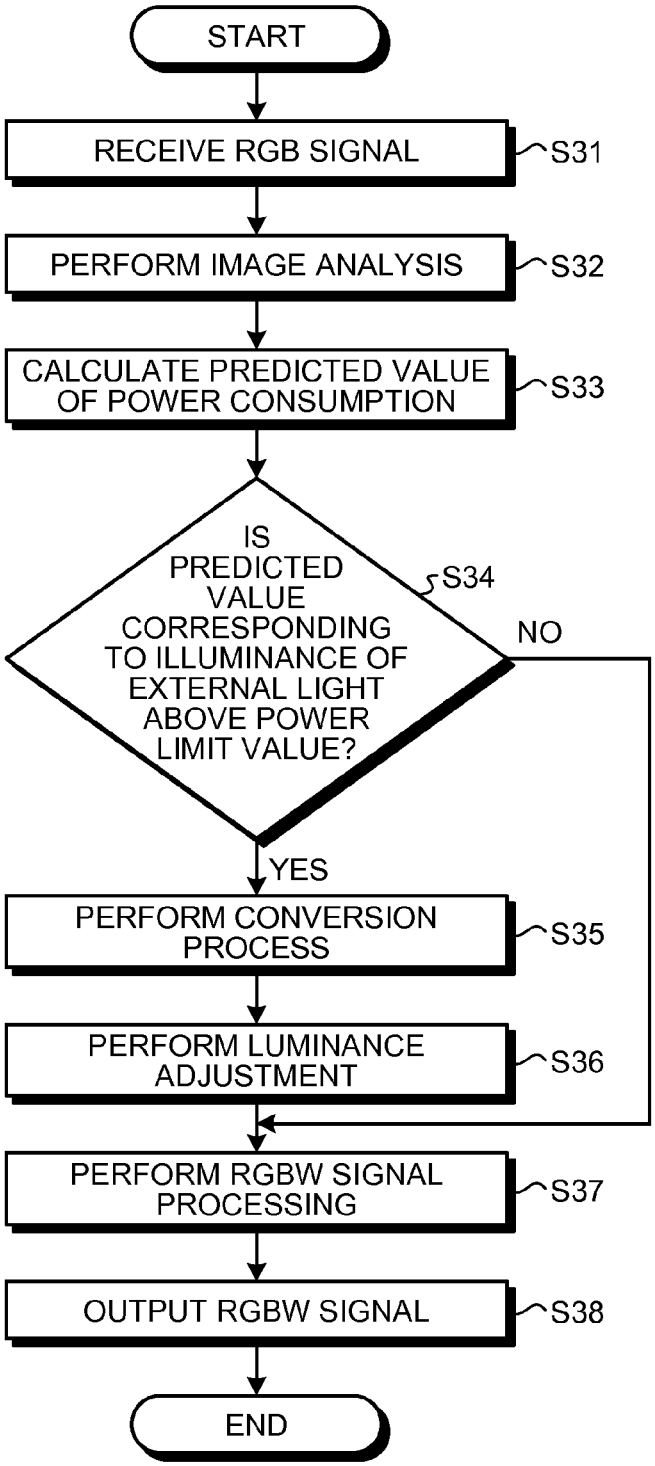
FIG. 22 is a flowchart for explaining a color conversion method according to a third embodiment.
Figure 23:
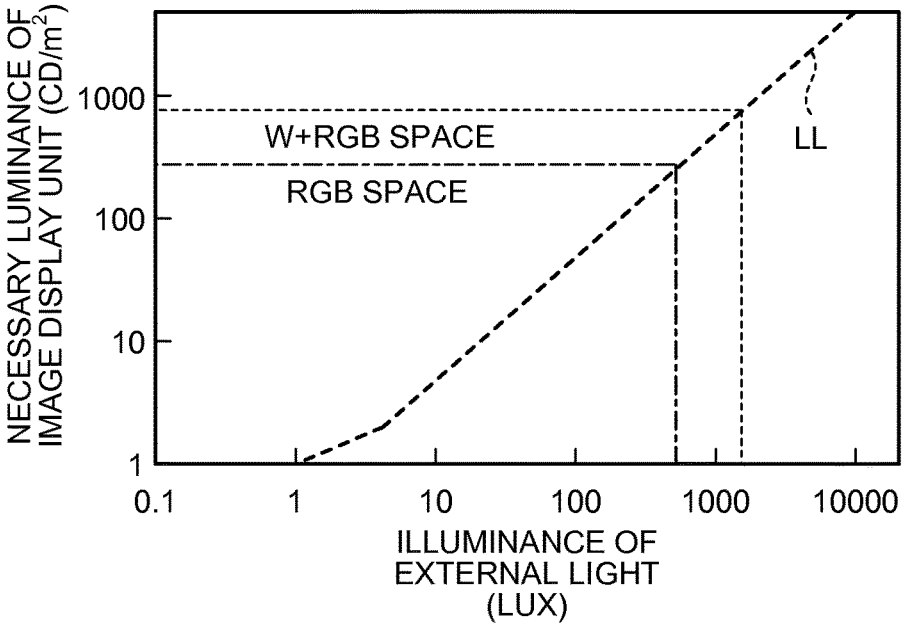
FIG. 23 is an explanatory diagram for explaining a look-up table indicating a necessary luminance of a display with respect to illuminance of external light according to the third embodiment.
Figure 24:
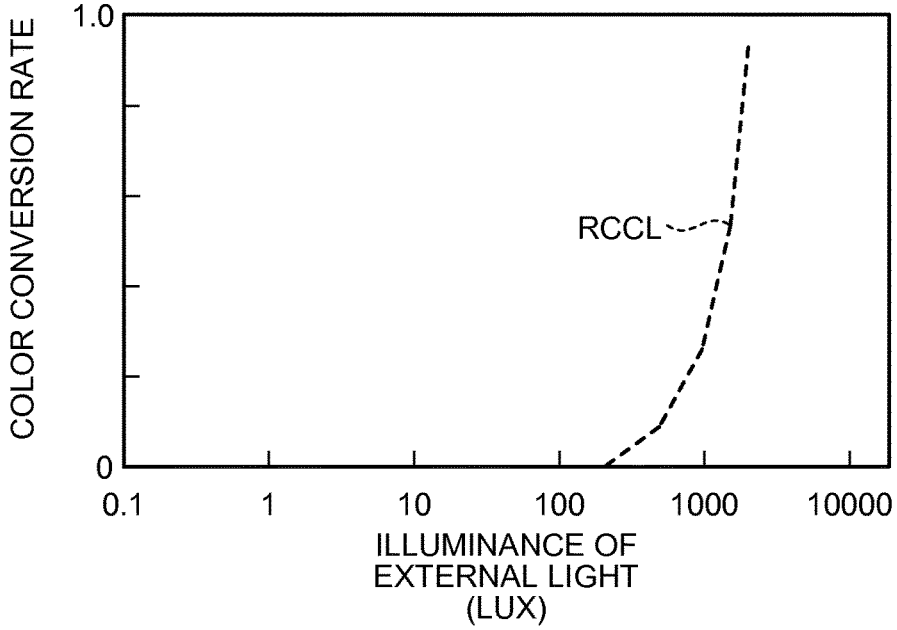
FIG. 24 is an explanatory diagram for explaining a look-up table indicating a color conversion rate corresponding to the illuminance of external light according to the third embodiment.

FIG. 22 is a flowchart for explaining a color conversion method according to the third embodiment. FIG. 23 is an explanatory diagram for explaining a look-up table indicating a necessary luminance of a display with respect to illuminance of external light according to the third embodiment. FIG. 24 is an explanatory diagram for explaining a look-up table indicating a color conversion rate corresponding to the illuminance of external light according to the third embodiment. The same components as those of the above described embodiments are denoted by the same reference numerals and symbols, and the same explanation will not be repeated.

The display device 100 according to the third embodiment includes, similarly to the display device 100 according to the above described first embodiment, the fourth sub-pixel 32W for outputting the fourth color (white color) in each of the pixels 31; therefore, a dynamic range of the value in the HSV color space can be extended as illustrated in FIG. 6. If the illuminance of external light is relatively high, the display device 100 needs to increase the value of the image display unit 30 to improve the visibility. For example, the conversion processing unit 10 of the display device 100 according to the third embodiment stores therein correlation information LL indicating necessary luminance of the image display unit 30 with respect to the illuminance of external light as illustrated in FIG. 23. When the value of the image display unit 30 is increased in accordance with the illuminance of external light without limitation and in excess of the maximum value that is representable in the RGB space displayed with the first sub-pixel 32R, the second sub-pixel 32G, and the third sub-pixel 32B so as to perform display in a W+RGB space that is displayable with the first sub-pixel 32R, the second sub-pixel 32G, the third sub-pixel 32B, and the fourth sub-pixel 32W, power consumption increases and may exceed the threshold of the power limit value of the display device 100 depending on display image data of an input video signal.

Therefore, the display device 100 according to the third embodiment performs a color conversion method according to the third embodiment as illustrated in FIG. 22. In the color conversion method on an input signal supplied to the image display unit according to the third embodiment, the conversion processing unit 10 receives the first input signal SRGB1 including the first color information that is obtained based on an input video signal and that is used for display at a predetermined pixel (Step S31). The first color information is subjected to gamma conversion as appropriate, and a value in the RGB coordinate system is converted to an input value in the HSV color space.

Subsequently, at an image analysis step (Step S32), the conversion processing unit 10 performs an image analysis on the input video signal. Alternatively, at the image analysis step (Step S32), the conversion processing unit 10 acquires image analysis information on the input video signal, which is calculated through other processes.

As a result of the image analysis on the input video signal, the conversion processing unit 10 calculates a predicted value of power consumption (Step S33). The conversion processing unit 10 can calculate a predicted value of power consumption corresponding to the setting value of the illuminance of external light by adding the correlation in the look-up table illustrated in FIG. 23 to a power consumption that is obtained by calculating a power consumption of a single frame, in which total amounts of lighting of the self-emitting elements of the first sub-pixels 32R, the second sub-pixels 32G, the third sub-pixels 32B, and the fourth sub-pixels 32W of all of the pixels are added from pieces of the first color information used for display at respective predetermined pixels based on the first input signal SRGB1 input at Step S31.

As illustrated in FIG. 22, if the predicted value of power consumption corresponding to the illuminance of external light is not above the threshold of the power limit value (NO at Step S34), the conversion processing unit 10 proceeds to Step S37.

As illustrated in FIG. 22, if the predicted value of power consumption is above the threshold of the power limit value (YES at Step S34), the conversion processing unit 10 proceeds to Step S35. The conversion processing unit 10 stores therein, in advance, a look-up table indicating, as the setting value of the panel luminance illustrated in FIG. 20, a correlation curve RCCL of a color conversion rate corresponding to the illuminance of external light.

The conversion processing unit 10 according to the third embodiment calculates the color conversion rate RCCL based on information on the color conversion rate corresponding to the illuminance of external light as illustrated in FIG. 24. Therefore, the conversion processing unit 10 according to the third embodiment can perform calculations by adding a weight of the color conversion rate RCCL in addition to the color conversion rate corresponding to the power consumption that increases or decreases for each frame of each display image data SG of an input video signal. Consequently, the conversion processing unit 10 can calculate the predicted value of power consumption in accordance with a setting of the panel luminance corresponding to the illuminance of external light.

The conversion processing unit 10 according to the third embodiment performs at least one of the hue conversion step and the saturation conversion step at the conversion processing step (Step S35). The process from Step S35 to Step S38 is the same as the process from Step S15 to Step S18 according to the first embodiment, and therefore, explanation thereof will be omitted.

As described above, the conversion processing unit 10 calculates the predicted value of power consumption with a setting of the panel luminance corresponding to the illuminance of external light. Therefore, the conversion processing unit 10 can perform the color conversion process on the first input signal including the first color information at the color conversion rate associated with the predicted value of power consumption corresponding to the illuminance of external light. Consequently, even if a panel luminance greater than the maximum value of the RGB space that is displayable with the first sub-pixel 32R, the second sub-pixel 32G, and the third sub-pixel 32B is set while the external illuminance is high, it becomes possible to suppress the possibility that the power consumption exceeds the threshold of the power limit value LPW of the display device 100 depending on display image data of an input video signal. As a result, the display device 100 according to the third embodiment can ensure the visibility even in an environment with relatively high illuminance of external light.

For example, as illustrated in FIG. 6, in a region with a relatively high saturation close to a primary color, it is difficult to increase a value V. Therefore, the conversion processing unit 10 according to the embodiment reduces a saturation to enable a display in the W+RGB space that is displayable with lighting of the fourth sub-pixel 32W in excess of the maximum value that is representable in the RGB space, so that the value V can be increased.

According to the embodiment, it is possible to provide a display device and a color conversion method capable of suppressing power consumption in an image display unit that lights self-emitting elements.

APPLICATION EXAMPLES

With reference to FIG. 25 to FIG. 33, application examples of the display device 100 described in the first to the third embodiments and the modifications will be described below. In the following, the first to the third embodiments and the modifications are collectively referred to as an embodiment. FIG. 25 to FIG. 33 are diagrams illustrating exemplary electronic apparatuses to which the display device according to the embodiment is applied. The display device 100 according to the embodiment may be applied to an electronic apparatus in various fields, such as a mobile phone, a portable terminal device including a smartphone or the like, a television device, a digital camera, a laptop personal computer, a video camera, or a meter provided in a vehicle. In other words, the display device 100 according to the embodiment may be applied to an electronic apparatus in various fields to display, as an image or video, a video signal input from an external apparatus or a video signal generated inside thereof. The electronic apparatus includes a control device that supplies a video signal to the display device 100 and controls operation of the display device 100.

Application Example 1

Figure 25:
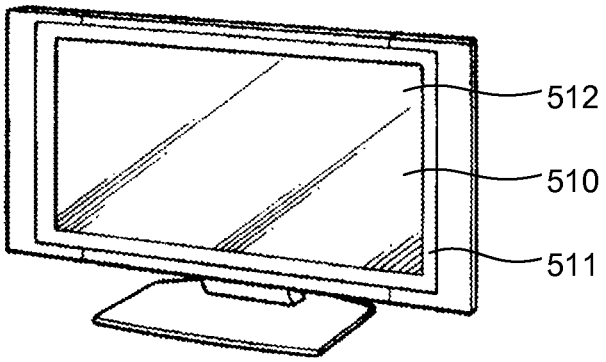
FIG. 25 is a diagram illustrating an exemplary electronic apparatus to which the display device according to the embodiment is applied.

FIG. 25 illustrates a television device, as an electronic apparatus, to which the display device 100 according to the embodiment is applied. The television device includes, for example, a video display screen unit 510 including a front panel 511 and a filter glass 512. The video display screen unit 510 corresponds to the display device 100 according to the embodiment.

Application Example 2

Figure 26:
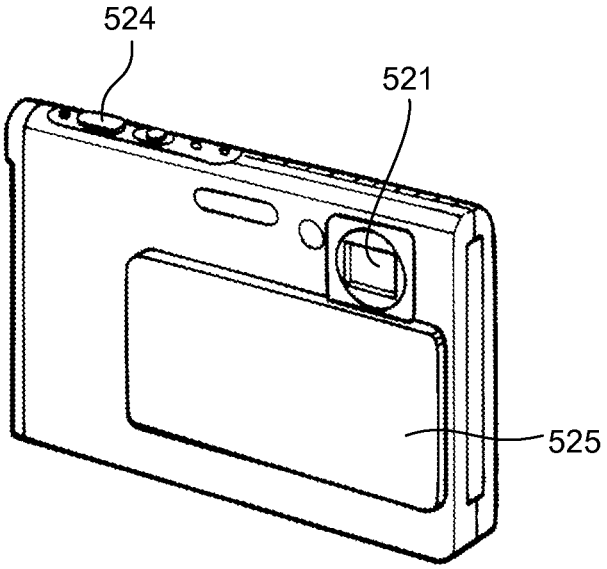
FIG. 26 is a diagram illustrating an exemplary electronic apparatus to which the display device according to the embodiment is applied.
Figure 27:
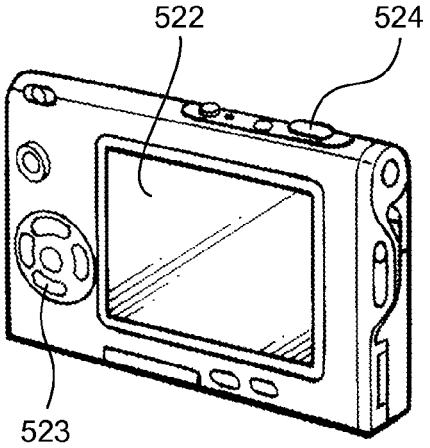
FIG. 27 is a diagram illustrating an exemplary electronic apparatus to which the display device according to the embodiment is applied.

FIG. 26 and FIG. 27 illustrate a digital camera, as an electronic apparatus, to which the display device 100 according to the embodiment is applied. The digital camera includes, for example, a light-emitting unit 521 for flash, a display unit 522, a menu switch 523, and a shutter button 524. The display unit 522 corresponds to the display device 100 according to the embodiment. As illustrated in FIG. 26, the digital camera includes a lens cover 525, and an imaging lens appears when the lens cover 525 is slid. The digital camera can capture digital pictures by receiving incident light through the imaging lens.

Application Example 3

Figure 28:
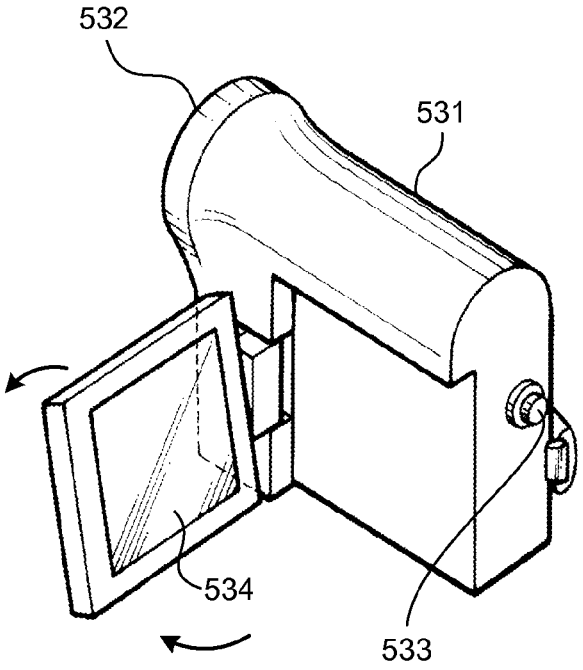
FIG. 28 is a diagram illustrating an exemplary electronic apparatus to which the display device according to the embodiment is applied.

FIG. 28 illustrates an exterior of a video camera, as an electronic apparatus, to which the display device 100 according to the embodiment is applied. The video camera includes, for example, a body 531, a subject imaging lens 532 provided on a front surface of the body 531, a start/stop switch 533 for imaging, and a display unit 534. The display unit 534 corresponds to the display device 100 according to the embodiment.

Application Example 4

Figure 29:
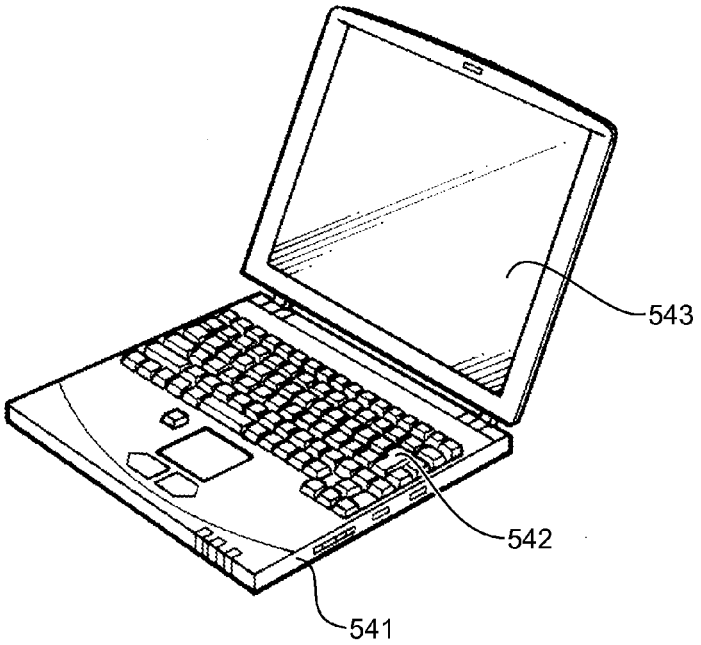
FIG. 29 is a diagram illustrating an exemplary electronic apparatus to which the display device according to the embodiment is applied.

FIG. 29 illustrates a laptop personal computer, as an electronic apparatus, to which the display device 100 according to the embodiment is applied. The laptop personal computer includes, for example, a body 541, a keyboard 542 for inputting text or the like, and a display unit 543 for displaying images. The display unit 543 corresponds to the display device 100 according to the embodiment.

Application Example 5

Figure 30:
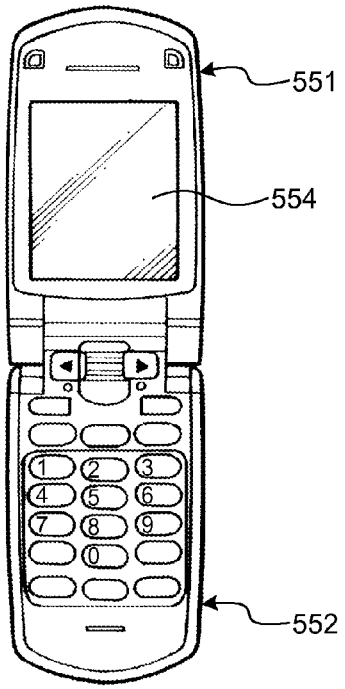
FIG. 30 is a diagram illustrating an exemplary electronic apparatus to which the display device according to the embodiment is applied.
Figure 31:
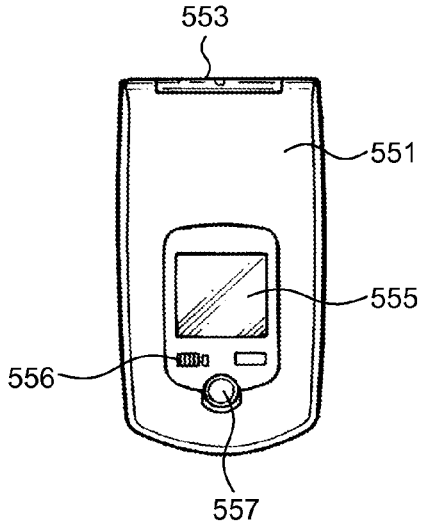
FIG. 31 is a diagram illustrating an exemplary electronic apparatus to which the display device according to the embodiment is applied.

FIG. 30 and FIG. 31 illustrate a mobile phone, as an electronic apparatus, to which the display device 100 is applied. FIG. 30 is a front view of the mobile phone in an opened state. FIG. 31 is a front view of the mobile phone in a folded state. The mobile phone includes, for example, an upper case 551 and a lower case 552 that are joined by a connecting part (hinge) 553, and also includes a display 554, a sub-display 555, a picture light 556, and a camera 557. The display device 100 is mounted on the display 554. Therefore, the display 554 of the mobile phone may have a function to detect touch operation, in addition to a function to display images.

Application Example 6

Figure 32:
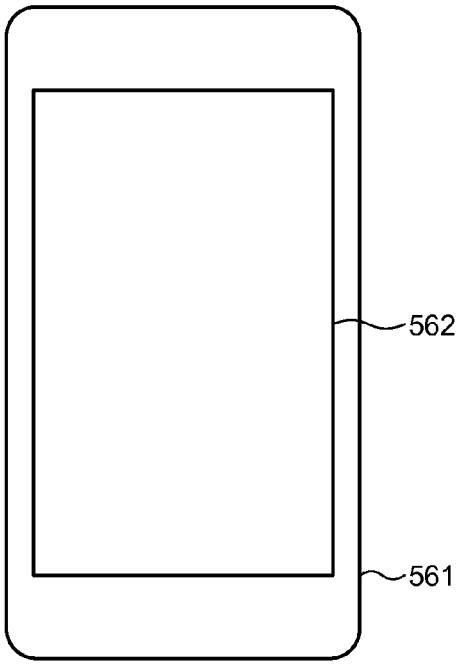
FIG. 32 is a diagram illustrating an exemplary electronic apparatus to which the display device according to the embodiment is applied.

FIG. 32 illustrates an information portable terminal, as an electronic apparatus, that operates as a portable computer, a mobile phone with a plurality of functions, a portable computer capable of performing a telephone call, or a portable computer capable of performing communication, and that may be called as a smartphone or a tablet terminal. The information portable terminal includes, for example, a display unit 562 on a surface of a case 561. The display unit 562 corresponds to the display device 100 according to the embodiment.

Application Example 7

Figure 33:
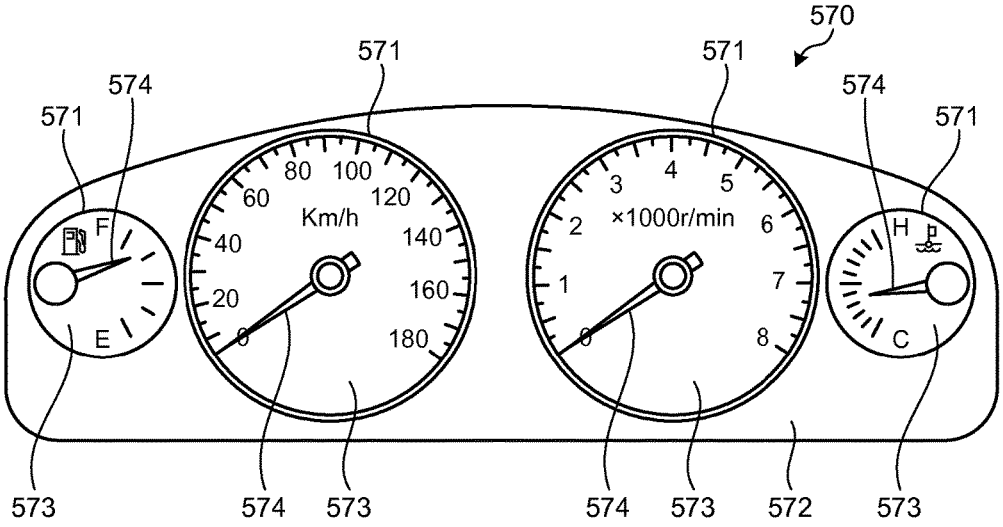
FIG. 33 is a diagram illustrating an exemplary electronic apparatus to which the display device according to the embodiment is applied.

FIG. 33 is a schematic configuration diagram of a meter unit that serves as an electronic apparatus according to the embodiment and which is mounted on a vehicle. A meter unit (the electronic apparatus) 570 illustrated in FIG. 33 includes a plurality of display devices 571, each of which corresponds to the display device 100 according to the embodiment and serves as a fuel meter, a water temperature meter, a speed meter, or a tachometer. The display devices 571 are covered by a single outer panel 572.

Each of the display devices 571 illustrated in FIG. 33 includes a combination of a panel 573 serving as a display means and a movement mechanism serving as an analog display means. The movement mechanism includes a motor serving as a driving means and a pointer 574 rotated by the motor. As illustrated in FIG. 33, in each of the display devices 571, a scale, a warning, and the like can be displayed on a display surface of the panel 573, and the pointer 574 of the movement mechanism can rotate on the display surface side of the panel 573.

In FIG. 33, the display devices 571 are provided on the single outer panel 572; however, the embodiment is not thus limited. It may be possible to provide the single display device 571 in a region surrounded by the outer panel 572, and display a fuel meter, a water temperature meter, a speed meter, a tachometer, and the like on the display device.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A display device comprising:

an image display unit including a plurality of pixels, each of the pixels including a first sub-pixel for displaying a red component according to an amount of lighting of a self-emitting element;

a second sub-pixel for displaying a green component according to an amount of lighting of a self-emitting element;

a third sub-pixel for displaying a blue component according to an amount of lighting of a self-emitting element; and a fourth sub-pixel for displaying an additional color component different from the respective components of the first sub-pixel, the second sub-pixel, and the third sub-pixel according to an amount of lighting of a self-emitting element, and having a higher luminance or a higher power efficiency to display the additional color component as compared to representation with the first sub-pixel, the second sub-pixel, and the third sub-pixel;

a conversion processing circuit configured to:

perform, for all of pixels, an image analysis on first color information used for display at a predetermined pixel, if a predicted value of power consumption that is obtained as a total amount of lighting of the self-emitting elements according to the image analysis is above a power limit value, calculate a color conversion rate associated with the predicted value of power consumption based on a look-up table or a conversion formula stored therein in advance, and according to which the color conversion rate increases with increase of the predicted value of power consumption, perform a color conversion process on a first input signal including the first color information at the color conversion rate to obtain second color information, and output a second input signal including the second color information, and if the predicted value of power consumption is below the power limit value, output the first input signal including the first color information; and a fourth sub-pixel signal processing circuit configured to output, to a drive circuit that drives the image display unit, a third input signal including third color information with the red component, the green component, the blue component, and the additional color component that are converted based on the first color information in the first input signal or the second color information in the second input signal output from the conversion processing circuit;

wherein the conversion processing circuit performs a calculation to reduce a saturation such that an amount of saturation attenuation varies according to a hue of the first color information.

2. The display device according to claim 1, wherein the conversion processing circuit calculates the predicted value of power consumption corresponding to an input setting value of a panel luminance.

3. The display device according to claim 1, wherein the conversion processing circuit calculates the predicted value of power consumption in accordance with a setting of a panel luminance corresponding to illuminance of external light.

4. The display device according to claim 1, wherein the conversion processing circuit performs a calculation to reduce a saturation by increasing the amount of saturation attenuation with a decrease in a saturation of the first color information.

5. The display device according to claim 1, wherein the conversion processing circuit converts a hue such that a corresponding power value of the second color information becomes smaller than a corresponding power value of the first color information.

6. A color conversion method on an input signal supplied to a drive circuit of an image display unit, the image display unit including a plurality of pixels, each of the pixels including:

a first sub-pixel for displaying a red component according to an amount of lighting of a self-emitting element;

a second sub-pixel for displaying a green component according to an amount of lighting of a self-emitting element;

a third sub-pixel for displaying a blue component according to an amount of lighting of a self-emitting element; and a fourth sub-pixel for displaying an additional color component different from the respective components of the first sub-pixel, the second sub-pixel, and the third sub-pixel according to an amount of lighting of a self-emitting element, and having a higher luminance or a higher power efficiency to display the additional color component as compared to representation with the first sub-pixel, the second sub-pixel, and the third sub-pixel, the color conversion method comprising:

performing by a conversion processing circuit, for all of pixels, an image analysis on first color information used for display at a predetermined pixel;

calculating by the conversion processing circuit, if a predicted value of power consumption that is obtained as a total amount of lighting of the self-emitting elements according to the image analysis is above a power limit value, a color conversion rate associated with the predicted value of power consumption based on a look-up table or a conversion formula stored therein in advance, and according to which the color conversion rate increases with increase of the predicted value of power consumption, performing by the conversion processing circuit a color conversion process on a first input signal including the first color information at the color conversion rate to obtain second color information, and outputting by the conversion processing circuit a second input signal including the second color information outputting the first input signal including the first color information by the conversion processing circuit, if the predicted value of power consumption is below the power limit value; and outputting by a fourth sub-pixel signal processing circuit, to the image display unit, a third input signal including third color information with the red component, the green component, the blue component, and the additional color component that are converted based on the first color information in the first input signal or the second color information in the second input signal output from the conversion processing circuit;

wherein the conversion processing circuit performs a calculation to reduce a saturation such that an amount of saturation attenuation varies according to a hue of the first color information.

* * * * *